US010926917B2

(12) United States Patent
Kerék

(10) Patent No.: US 10,926,917 B2
(45) Date of Patent: Feb. 23, 2021

(54) PALLET

(71) Applicant: Csaba Imre Kerék, Budapest (HU)

(72) Inventor: Csaba Imre Kerék, Budapest (HU)

( * ) Notice: Subject to any disclaimer, the term of this patent is extended or adjusted under 35 U.S.C. 154(b) by 0 days.

(21) Appl. No.: 16/485,505

(22) PCT Filed: Feb. 12, 2018

(86) PCT No.: PCT/HU2018/000006

§ 371 (c)(1),
(2) Date: Aug. 13, 2019

(87) PCT Pub. No.: WO2018/146502

PCT Pub. Date: Aug. 16, 2018

(65) Prior Publication Data

US 2020/0047946 A1 Feb. 13, 2020

(30) Foreign Application Priority Data

Feb. 13, 2017 (HU) ..... P1700062

(51) Int. Cl.
*B65D 19/38* (2006.01)
*B65D 19/00* (2006.01)

(52) U.S. Cl.
CPC ..... *B65D 19/0026* (2013.01); *B65D 2519/00019* (2013.01); *B65D 2519/00054* (2013.01);
(Continued)

(58) Field of Classification Search
CPC ..... B65D 2519/00019; B65D 2519/00054; B65D 2519/00089; B65D 2519/00124;
(Continued)

(56) References Cited

U.S. PATENT DOCUMENTS 5,372,074 A * 12/1994 Kilpatrick ..... B65D 19/0012 108/51.3
6,745,703 B2 * 6/2004 Torrey ..... B65D 19/0012 108/51.11

(Continued)

FOREIGN PATENT DOCUMENTS

CN 2787584 Y 6/2006
CN 2880699 Y 3/2007

(Continued)

OTHER PUBLICATIONS

International Searching Authority, European Patent Office, International Search Report and Written Opinion issued in corresponding PCT Application No. PCT/HU2018/000006, dated Jun. 20, 2018 (14 pages).

*Primary Examiner* — Matthew W Ing
(74) *Attorney, Agent, or Firm* — Wood Herron & Evans LLP

(57) ABSTRACT

A pallet comprising a cover element (12) having a load bearing surface and a bottom surface being opposite the load bearing surface (11), and foot elements (10), each having a foot surface (15) being parallel with the bottom surface, and side walls (17) connecting the foot surface (15) and the bottom surface, the foot elements (10) being connected to the bottom surface (13), wherein the side walls (17) facing to each other of adjacent foot elements (10) being parallel with each other. The pallet further comprising a central stiffening element being supported against the side walls (17) facing to each other of adjacent foot elements (10) and being abutted against the bottom surface of the cover element (12), and the cover element (12) and the foot elements (10) being made from foldable sheet material.

17 Claims, 19 Drawing Sheets

(52) U.S. Cl.
CPC ..... *B65D 2519/00124* (2013.01); *B65D 2519/00273* (2013.01); *B65D 2519/00288* (2013.01); *B65D 2519/00323* (2013.01); *B65D 2519/00333* (2013.01); *B65D 2519/00437* (2013.01); *B65D 2519/00562* (2013.01)

(58) Field of Classification Search
CPC ..... B65D 19/0026; B65D 2519/00273; B65D 2519/00288; B65D 2519/00323; B65D 2519/00333; B65D 2519/00437; B65D 2519/00562
See application file for complete search history.

(56) References Cited

U.S. PATENT DOCUMENTS

| | | | | |
|---|---|---|---|---|
| 6,817,586 | B1 | 11/2004 | Lin | |
| 7,905,183 | B2 | 3/2011 | Gibson et al. | |
| 2005/0241549 | A1* | 11/2005 | Gordon | B65D 77/003 108/51.3 |
| 2006/0065170 | A1* | 3/2006 | Chen | B65D 19/0026 108/51.3 |
| 2009/0188411 | A1* | 7/2009 | Gibson | B65D 19/0022 108/51.3 |
| 2014/0345501 | A1 | 11/2014 | Lundius | |
| 2018/0244430 | A1* | 8/2018 | Berkes | B65D 19/0073 |

FOREIGN PATENT DOCUMENTS

| | | | |
|---|---|---|---|
| EP | 1095867 | A1 | 5/2001 |
| JP | S6199525 | U | 6/1986 |
| JP | H09187875 | A | 7/1997 |
| JP | 2015134640 | A | 7/2015 |

* cited by examiner

PALLET

This application claims priority, under Section 371 and/or as a continuation under Section 120, to PCT Application No. PCT/HU2018/000006, filed on Feb. 12, 2018, which claims priority to Hungarian Application No. P1700062, filed on Feb. 13, 2017.

TECHNICAL FIELD

The invention relates to a pallet comprising constituent parts made from foldable sheet material, preferably paper, particularly corrugated paper.

BACKGROUND ART

Pallets are typically applied for storing and moving larger amounts of goods. The most widely applied pallets are made of wood (in different sizes), but pallets may also be made of metal, plastic and paper.

Placed by standards and usage requirements there are certain size/dimensions limitations to pallets. There are two widely applied, typical pallet dimensions:

1. the so-called EUR pallet—1200×800×144 (+7) mm;
2. the so-called US pallet—1200×1000×144 mm.

The height of the EUR pallet may be as large as 151 mm, but it is more expedient to apply the lower-height type. Uncertainty as to the dimensions of the US pallet may be introduced by the fact that its dimensions are specified in inches.

Pallets in general have the following functionalities, features and limitations:

(a) load bearing capability: pallets are adapted to bear the weight of the cargo, i.e. to take loads (evenly) distributed across their surface;

(b) lifting capability: the pallet can be lifted applying lifting equipment;

(c) handling capability: providing for the so-called "four way" handling, i.e. that the pallet can be handled from all sides applying handling equipment;

(d) utilization in storage systems: it is rack-storable ("open rack" storage; the pallet is supported on its two outboard legs), i.e. it preferably withstands the so-called bending loads (a load type subjecting to loads the middle portion of a pallet supported at both extremities, that is, unsupported in the middle), the pallets may preferably be stacked, etc. (this requirement is typically not met by pallets made from foldable paper material, for example paper);

(e) suitable preferably for different packaging solutions: it should be primarily suited for automated strapping;

(f) reusability.

In addition to performing the above listed functions, a pallet should preferably fulfil the following additional requirements:

(a) it has the smallest possible weight (required for the economy of shipping), (b) it is environmentally friendly, (c) it can be recycled, (d) it has the best possible anti-bacterial characteristics, and (e) its production costs are as low as possible.

Of the above, some features can be provided by pallets made of paper; accordingly, a number of pallets made of paper materials are known.

In U.S. Pat. No. 7,905,183 B2 a cardboard pallet is disclosed that comprises a flat covering sheet, with a system of foot elements being attached to it. In the system of foot elements there are arranged both longitudinal and transverse-direction foot elements; with both comprising support surfaces. The longitudinal and transverse-direction foot elements are interconnected to provide a shape-fitting connection, for which they are mutually weakened by cuts. In a disadvantageous manner the lower zone of the longitudinal foot elements—which is of key importance for load bearing capacity—is weakened. Another great disadvantage of the pallet according to the document is that its structure is exceedingly complex.

A pallet made of a paper material is disclosed in U.S. Pat. No. 8,113,129 B1. In this approach the system of legs of the pallet is even more complex than the one disclosed in U.S. Pat. No. 7,905,183 B2, with the legs being interconnected at several points. For the interconnections, cuts are made in the upper and bottom faces of the legs, into which the legs extending in a transverse direction can be inserted.

A pallet made of multi-layer paper or cardboard is disclosed in WO 95/29849 A1. The pallet according to the document is composed of so-called "tubes" (prism-shaped pieces) made from this multi-layer material. The covering sheet is made from tubes having a more oblong section, while the foot elements are made from essentially square-section tubes. Two through openings adapted for receiving the forklift forks are of course arranged in each of the foot elements. Studs with square cross section are arranged in the foot elements. A reinforcing element that is made from a separate sheet piece, being bent at nearly 90°, interconnecting the foot element and the covering sheet is arranged on the side of the pallet.

A paper pallet is disclosed in WO 2005/090176 A1, of which the legs (foot elements) are made from a preform by folding. Cylindrical studs are arranged in the foot element as reinforcing elements. To provide stiffening for the cover, according to FIG. 3 of the document, a thickened region is applied in the cover element at the side opposite the connections of the foot elements.

A pallet made of corrugated paper is disclosed in FR 2,936,231 B1, wherein the foot element is formed by folding along longitudinal fold lines. In the pallet according to the document, rod-like stiffeners extending through the legs are also applied. The rods extending through the legs are not arranged at the through openings of the pallet but at the thicker leg portions not affected by the through openings.

In WO 87/03859 A1 a pallet made of a paper material is disclosed. The pallet comprises three legs arranged in a longitudinal direction. The legs are interconnected by transversely extending tube elements passed through transverse openings formed in the legs. The tube-like elements are kept in place by friction forces arising between the openings and the tube-like elements.

A further pallet made of cardboard is disclosed in U.S. Pat. No. 5,483,875. Disadvantageously, this pallet has a very complicated structure. A pallet made of cardboard is also disclosed in WO 95/25672 A1.

In the pallet disclosed in WO 95/29102 A1, honeycomb structures are applied in the following arrangement. In the pallet according to the document it is the covering sheet (the entire covering sheet constituting the loading surface) that is made of a paper material having a honeycomb internal structure, with a respective stud with a honeycomb structure being arranged in the legs adhesively bonded to the covering sheet, i.e. between the leg openings and at both ends of each leg. The studs are introduced into the U-shape turned on its side that constitutes the legs, while the paper sheet adhesively bonded to the cover sheet and bottom sheet of the honeycomb is bonded to the legs. A similar paper pallet is disclosed in WO 92/12061 A1. As with the previous one, in this solution the covering sheet (the load-bearing rectangular sheet) is made from a honeycomb structure, with the legs, also comprising honeycomb elements, being connected to the underside thereof. A great disadvantage of these pallets (and other pallets based on the same concept) is that loading capacity is basically determined by the configuration of the cover (material thickness, etc.) and the cover is supported by legs determined by the studs. Here the legs are therefore of a relatively simple configuration, with each of the studs performing its action by itself rather than in cooperation with other studs.

Further cardboard pallets are disclosed in US 2003/0000432 A1, US 2005/0011418 A1, U.S. Pat. No. 3,131,656 and WO 98/18686 A1, and in the Hungarian utility model with registration No. 3016.

The mass of the unit load most frequently shipped applying pallets is 800-1000 kg. The main field of application of pallets is storage and shipping of cargo having the mass of this unit load. The most important deficiency of known paper pallets currently in use is that in this major field of application they could not fulfil the requirements related to bending—and optionally, distributed—load (loading capacity), and that the currently available designs do not allow for automated strapping. Besides that, reusability has been negated by the sensitivity of the pallets to water and humidity (softening, deterioration of strength-related parameters).

In view of known approaches, therefore, there is a demand for pallets made from foldable sheet material that can comply with these load requirements. Taking into account the prior art approaches, there is a demand for pallets made of a paper material that—compared to the very complicated known solutions—have relatively simple structure, and thus can be manufactured more easily, in fewer steps, or in a simpler fashion.

DESCRIPTION OF THE INVENTION

The primary object of the invention is to provide a pallet, which is free of disadvantages of prior art solutions to the greatest possible extent.

The object of the invention is to provide a pallet that fulfils the requirements related to bending- and, preferably, to distributed load-bearing parameters (that is suitable for the storage, warehousing and shipping of masses typically required from the pallets), and that also preferably allows for automated strapping.

The further object of the invention is to provide a pallet that, in addition to fulfilling the above objectives, has the simplest possible structural configuration. The object of the invention is to provide a pallet that is reusable as many times as possible.

The objectives according to the invention have been fulfilled by providing the pallet defined in claim 1. Preferred embodiments of the invention are defined in the dependent claims.

The above described shortcomings are eliminated by the pallet according to the invention while preserving the general advantages resulting from the application of a foldable sheet material (preferably, paper, or corrugated paper sheet/board ("CPB")). Thanks to its configuration, the pallet according to the invention are particularly suited for storage, shipping and warehousing of the unit load of 800-1500 kg is certain embodiments, as well as automated strapping and multiple reuse. The pallet according to the invention has a very low weight and it can be produced in a cost-effective manner (due to its relatively simple structural configuration).

Compared to known pallets made from foldable sheet material (for example corrugated paper) the pallet according to the invention is especially resistant against bending load, with its loading capacity being exceedingly well-adjustable thanks to its structural configuration, i.e. it can be dimensioned for expected loads. In accordance with the principles applied according to the invention the invention is particularly well suited for multiple reuse.

The foldable sheet material of the pallet according to the invention applied as base material allows for much greater flexibility in the structural configuration of the pallet than conventionally applied wood materials.

The construction has to fulfill the joint requirements of loading capacity, liftability, rack storage, and automated strapping. The known approaches have some disadvantages related to these requirements, not fulfilling without exception the requirements in cases of high-load cargo. The construction according to the invention fulfils these joint requirements, and also has advantages from the aspects of material use, the optimization of loading capacity, and manufacturing. The advantages exhibited in comparison to the known approaches have been achieved thanks to the novel solutions applied to the design concept.

BRIEF DESCRIPTION OF THE DRAWINGS

Preferred embodiments of the invention are described below by way of example with reference to the following drawings, where.

MODES FOR CARRYING OUT THE INVENTION

The pallet according to the invention comprises

- a cover element (covering member) having a load bearing surface and a bottom surface being opposite the load bearing surface,
- foot elements (foot members), each having a foot surface being parallel with the bottom surface, and side walls connecting the foot surface and the bottom surface, the foot elements being connected to the bottom surface, wherein the side walls facing to each other of adjacent foot elements being parallel with each other, and
- further comprises a central stiffening element (central stiffening member) being supported against the side walls facing to each other of adjacent foot elements, and being abutted against the bottom surface of the cover element, and the cover element and the foot elements are made from foldable sheet material.

Referring to FIGS. 1-21 a single embodiment is described in detail; in addition to that further embodiments are illustrated in FIGS. 22-28C, the most important difference between these embodiments being the different configuration of the central stiffening element. The central stiffening element generally provides for transverse stiffening function between the foot elements, and due to being abutted it also contributes to the proper tensioning of the cover element (cover).

Figure 22:
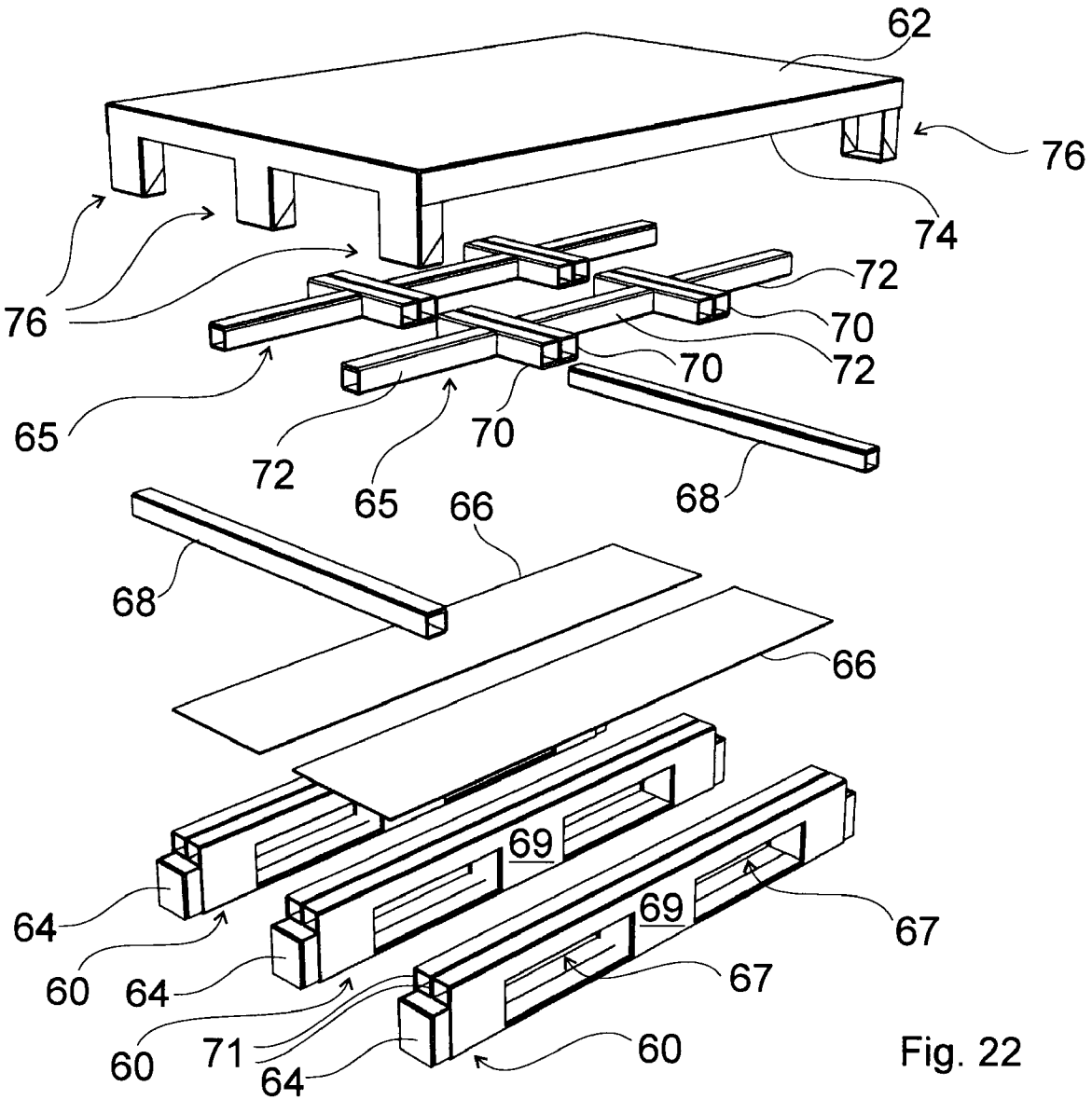
FIG. 22 is an exploded view of a further embodiment of the pallet according to the invention.

In FIG. 22 an embodiment that is very similar to the one depicted in FIGS. 1-21 is illustrated, with a central stiffening element 65. Accordingly, in the embodiment shown in FIGS. 1-21 a central stiffening element 25 comprises transverse stiffening profile elements 20 (profiled elements) and longitudinal stiffening profile elements 22, as shown in FIG. 17. The central stiffening element 25 therefore provides both transverse and longitudinal stiffening functionality; the adjective "central" in the name refers to the way it is arranged with respect to the longitudinal direction of the pallet and is included for differentiating it from other components that also have a stiffening functionality. It may also be called simply a stiffening element or even a (central) stiffening insert.

As illustrated in FIGS. 24A, 25, 26, 27 and 28A, the central stiffening elements can be configured in a number of ways, what is essential is that they have to be supported against oppositely situated side walls of the foot elements, and that they are abutted on the inside (bottom surface) of the cover element. Accordingly, the transverse (and longitudinal) support structures (central stiffening elements) are implemented as closed or open profiles, or block structures.

Figure 1:
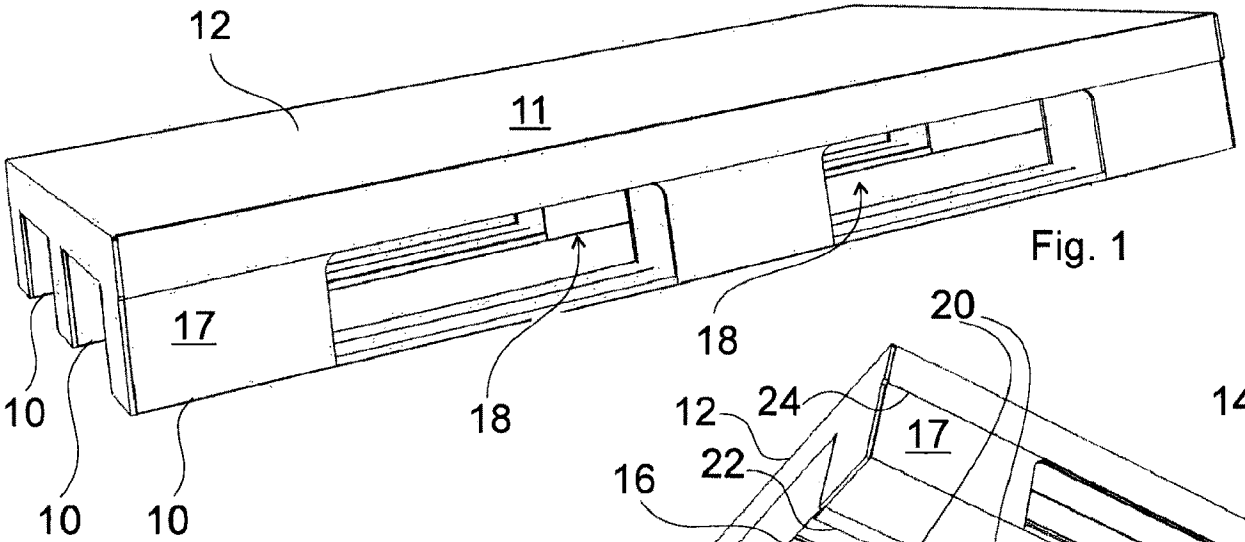
FIG. 1 is a drawing showing a view of an embodiment of the pallet according to the invention.

In certain embodiments (in all illustrated embodiments) two through openings (the through openings 18, 67) extending between the side walls of the respective foot element are formed in each foot element (in principle, more than two such openings can be arranged, but in order to allow forklifts forks to engage the pallet usually two openings are arranged, the through opening can also be termed a fork opening), a first height of the central stiffening element measured from the bottom surface is at least 50% of a first distance measured between the through openings and the bottom surface, and the central stiffening element is supported against the side walls of adjacent foot elements at a region extending from the through openings towards the bottom surface (i.e. it is supported at the narrower side wall section above the through openings, even along a smaller subsection thereof at the through openings, as in the embodiments of FIGS. 1 and 22, or along a longer section—even along the walls of cut-up cells, along edges, by means of sheet end contacts, or at the contacting sections of the structure—as in the embodiments of FIG. 24A, 25, 26, 27, or 28A).

In a further embodiment (also fulfilled by the illustrated embodiments), two through openings extending between the side walls of the respective foot element are formed in each of the foot elements, a first difference between a first distance of the through openings measured from the bottom surface and a first height of the central stiffening element measured from the bottom surface is smaller than 20% of the greater of the first distance or the first height (preferably smaller than 10% thereof), and the central stiffening element is supported against the side walls of adjacent foot elements at a region extending from the through openings towards the bottom surface.

It may therefore happen in this case that the protrusion (first distance) is greater at the through opening, but it may also be greater at the stiffening element (first height). The first distance is preferably greater or equal than the first height, i.e. the height of the central stiffening element measured from the bottom surface is at least 80% of the distance measured between the through openings and the bottom surface (their difference is smaller than 20%); thus, in this case the central stiffening element does not protrude to the through openings (in case the first height was the greater of the two it would slightly project out, this may happen if the first difference is smaller than 20% but it rather occurs with a difference below 10%; however, e.g. automated strapping can also be applied in the latter case).

Avoiding such a protrusion is also advantageous for strapping, because in this case the stiffening element is situated further inside than the upper edge of the through opening, i.e. rather than extending along a broken line when being passed above the stiffening element, the strap is tensioned between the two through openings. The other strap, arranged perpendicularly with respect to the first strap, may be passed underneath the first strap. This arrangement is preferred also because when the forklift fork is inserted into the through opening it does not have to "get through" a step (in case it passes along the upper edge), i.e. it cannot possibly get caught by the step.

Accordingly, in an embodiment the central stiffening element extends downwards as far as at least half of the narrower side wall section above the through openings. In such a case, in spite of the height difference, automated strapping can still be applied (provided, of course, that the pallet is a standard-size one), and a favourable level of transverse stiffening between the legs can also be provided by the central stiffening element. With standard-size pallets the distance of the through openings from the bottom surface is approximately 4-5 cm, and thus the above conditions imply that the height of the central stiffening element measured from the bottom surface is at least 2-2.5 cm, the height difference between the two being maximum 2-2.5 cm. As indicated by practical experience, a height difference of 2-2.5 cm can still be managed applying automated strapping.

The height difference is usually very low, by way of example maximum 0.5 cm. By adjusting the thickness of the stiffening element, it is possible to adjust the height difference. However, if, applying a standard-size (thickness) honeycomb mesh (grid) stiffening element results in a height difference of the same order of magnitude (approx. max. 0.5 cm), it also does not pose a problem for strapping. In case the longitudinal strapping is laid e.g. first, followed by the transverse straps, then the height difference will "take up" the height of the strap that was laid first, and due to that the strap that is laid next will not protrude at the contact location of the straps.

As it will be apparent in the embodiments illustrated in FIGS. 22-28C, the central stiffening element preferably has a cover sheet being arranged between the side walls facing to each other of the adjacent foot elements, at the side of the central stiffening element lying opposite the bottom surface. In the these embodiments therefore the cover sheets are considered to form a part of the central stiffening element, i.e. their height has to be included in the height thereof. Accordingly, if there is arranged a cover sheet then it is preferably the combined height of the central stiffening element (first height) and the cover sheet that is preferably at least 50% of the distance of the through openings measured from the bottom surface (first distance), or, in other embodiments, the difference between the height of the stiffening element and the distance of the through openings measured from the bottom surface is smaller than the 20%, preferably 10%, taking this thickness into consideration. Since the difference typically results from the difference between layer thicknesses, it is typically low. The technical effect of the central stiffening element (provision of transverse stiffening and tensioning the cover, preferably also longitudinal stiffening) is also more pronounced if the central stiffening element is as high as possible. In addition to that, the cover sheet is also very thin, having a thickness of a few millimetres.

The central stiffening element is preferably adhesively fixed to the side walls on which it is supported, and/or to the bottom surface against which it is abutted (seated); i.e. the supported and/or abutted portions of the central stiffening element are preferably adhesively fixed to the components being in contact with the supported and/or abutted portions. According to the above definition, in a pallet comprising two foot elements, a single central stiffening element is arranged, while in a pallet having three foot elements as illustrated in the figures a respective central stiffening element is arranged between each two of the foot elements, i.e. a total of two such stiffening elements are arranged. Therefore, such foot elements are applied in the pallet according to the invention which comprise a side surface adapted for providing support (typically this is situated between the through openings and the bottom surface forming the underside of the cover element).

It is important to note the following. Unlike in known approaches, in the present invention it is not the exact configuration of the foot elements what is most relevant, but rather that the cover (cover element) is stretched out by one or more central stiffening element arranged in such a number which corresponds to the number of foot elements (a separate stiffening element is applied between each two foot element), and that appropriate transverse and longitudinal stiffening is provided. With an appropriate configuration of the legs the loading capacity may be increased approximately to maximum 500-600 kg; the pallet cannot adapted to bear loads higher than that solely by modifying the configuration of the legs. A great advantage of the pallet according to the invention is that by applying the central stiffening element the loading capacity of the pallet increases significantly, and thus the pallet according to the invention becomes suitable for storing and transporting cargo that is generally required to be transported applying pallets (e.g. wooden pallets). Accordingly, a load bearing capacity of 800-1000 kg (or even greater) can be achieved.

Thanks to the application of the central stiffening element the bending strength of the pallet according to the invention is (much) higher compared to known approaches utilizing a self-standing (non-reinforced) cover. Known approaches (including the approaches utilizing honeycomb cover structure) are usually based on that it is simply sufficient to apply an appropriately rigid cover.

The function of the tensioned cover piece applied in accordance with the invention is to transfer the "inter-leg" loads (loads with an application point between the legs) to the legs (foot elements), and to increase the compression-zone load bearing capacity of the leg structure. By connecting (adhesively bonding) the central stiffening element to the tensioned cover and optionally to the legs the bending strength of the pallet structure is improved (by even as much as 25-50%) compared to applying conventional legs configured for maximum load.

Under load, or during transport the pallet is subjected to a number of various forces. Different forces arise in the cases where the pallet is subjected to the static load of the cargo, where the cargo is lifted by a forklift fork (inserting the fork from different sides and directions), or where the loaded pallet is stored in a rack. The central stiffening element performs the important function of distributing forces having an application point between the two legs across the top plane and side surfaces of the legs. In the case of a two-support holder (i.e. when the pallet is supported by two legs at its extremities) the vector diagram of the load force is triangular, while in the case of a distributed load the vector diagram of the force is rectangular due to the load distribution. In the case of distributed load the force can be cut in half (can be distributed between the legs), that is why it is important to provide load distribution. This requirement is therefore of primary importance for rack storage, because in such a case bending strength is the key factor.

In known approaches, "inter-leg" loads are transferred to the legs or even directly to the stubs via the cover. In addition to performing other functions, the central stiffening element applied in the invention distributes the inter-leg (inter-foot) load to the side surfaces of the legs (i.e. the side walls of the foot elements). The paper material of the cover element undergoes elastic stretching at the location of the instantaneous centre of mass (centre of gravity) of the cargo, but, as a result of the stretching, the load is transferred to the side surface of the legs by the transverse stiffening structure. When the cargo is lifted, the lift surface of the fork is increased by the transverse stiffening structure (it converts and transfers the surface area acted upon by the fork to the larger surface area of the cover element and to the legs).

The most widely applied pallets are typically of "four-way" type, which requires the inclusion of through openings in the foot elements (in addition to the lift locations situated between the foot elements). The pallets are therefore preferably adapted for lifting cargo (load) from all directions, and preferably also allow automated strapping.

Weaknesses of pallets made of paper manifest themselves when the pallets are stored in a rack. In this case the pallets behave as two-support holders, with the effect of the shear force manifesting itself in the bending of the pallet. The concept according to the invention is based on the application of a structure wherein the legs (foot elements) have the maximum compressive strength allowed by geometrical limitations. This purpose is served also by reinforcing the so-called "tensioned zone" (the appropriate configuration of the stiffening element) and the folded profile. Firstly, the tensioned and compressed zones can be considered to be constituted by the profiles arranged below the cover element. The outer (outermost, extreme, lateral) transverse stiffening profile element can be configured in two alternative ways (along the full width or between the foot elements), in both cases a profiled frame is produced under the cover element.

For the profile frame, the compression zone is located at the upper edge thereof, i.e. right under the cover element, while the tensioned zone is situated at the lower edges of the profiles, i.e. somewhat lower in the pallet. This approach can also be applied to the entire pallet structure, in which case the tensioned zone extends along the lower portions of the foot elements.

In order to increase compressive strength the foot elements are connected (adhesively bonded) directly to the cover (cover element), the so-called tensioned cover thus produced also improves the compression zone load bearing capacity of the pallet. However, if the legs are simply adhesively bonded to the cover, the transverse rigidity of the pallet may remain insufficient. The central stiffening element, i.e. the transverse (and longitudinal) stiffening system applied according to the invention in the pallet according to the invention serves for providing sufficient transverse rigidity.

The applied stiffening system is based on the principle that the closed or open profiles applied as stiffening elements (configured e.g. in a bellows-like fashion) or blocks (e.g. blocks with a honeycomb structure) are abutted directly against the cover (preferably they are adhesively bonded thereto). According to this arrangement, the cover undergoes elastic deformation (elongation), being subjected to the load placed on the portion between the foot elements (the load at the momentary centre of gravity), and, due to the shape fitting between the profile of the foot elements and the stiffening element (e.g., a honeycomb block), the load is transferred to the skirt (mantle) of the legs (the side walls of the foot elements), thereby reducing the effect of the shear force.

The most favourable results can be achieved by applying a block structure as central stiffening element because it gives especially high rigidity to the cover. As a result of that, the bending of the cover element is minimal, and the shear force is distributed optimally along the leg. In order to reduce the shear force, the force acting on the top plane of the foot element (this is the connection surface between the foot element and the cover element) is reduced; utilizing the central stiffening element it can be achieved that the sides of the foot element are subjected to distributed load. As far as bending strength is concerned, therefore, the force acting on the upper face plays an important role. This force is reduced—to a different degree in different embodiments—by the central stiffening element. The degree of reduction is determined by the structure of the stiffening element being preferably adhesively bonded to the covering sheet. A requirement for the structure is that it should not deteriorate the section modulus of the leg. This can be provided if the stiffening element is adhesively bonded only to the covering sheet, i.e. certain subcomponents of the stiffening element are not passed through the foot element (the side of the stiffening element may optionally be adhesively bonded to the side wall of the foot element, but it does not get therethrough).

A very important difference between the invention and the approach of WO 87/03859 A1 (referenced in the introduction) is that the transversely extending elements applied in the known approach are not supported against the side walls of the leg but instead they get (pass) through the leg. Accordingly, they do not function as transverse stiffeners between the legs as provided for in the present invention. Also, the transversely extending elements are not capable of providing support for the cover, because they are situated slightly under the top plane of the legs: they have to extend through the legs and thus have to be situated between the top and bottom sides of the profile element constituting the legs; they cannot be situated at its extremities because they would then be in the wall of the leg itself. The transversely extending elements are therefore spaced from the cover and the upper edge of the through opening formed in the legs by at least a distance equal to the thickness of a sheet. In contrast to that, according to the invention the component functioning as a transverse stiffener is supported against the side walls of the foot elements, and so it does not have to be arranged below the cover separated from it by a specific distance but can be abutted against the cover, while the underside thereof can be situated at the level of the through opening.

An important difference between the approach of WO 92/12061 A1 and the embodiment of the present invention applying a honeycomb structure as central stiffening element is that in the known approach the honeycomb mesh structure either forms the cover itself or is attached by adhesive bonding under the cover, with the foot elements being connected thereto, i.e. it is not placed between the foot elements. This results in a completely different mechanism of action, especially when the pallet is stored in a rack. In the case of the solution according to the invention the overall bending strength of the pallet is determined collectively by the central stiffening element and the foot elements. In contrast to that, in the known approach the overall bending strength is determined by the bending strength of the honeycomb block. In principle, and also based on empirical evidence it can be maintained that, for rack-stored pallets the solution according to the invention provides increased load bearing capacity under the same geometric conditions.

Figure 2:
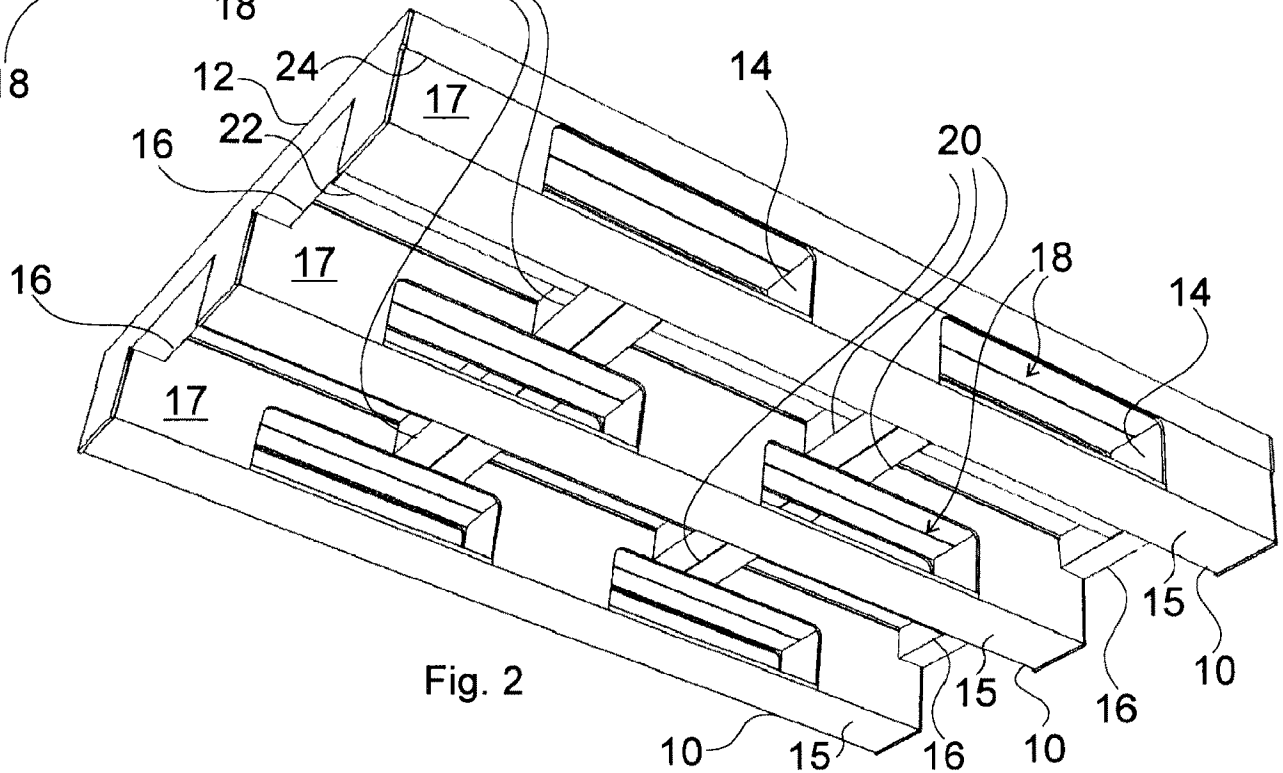
FIG. 2 is a drawing showing another view of the embodiment of the pallet according to the invention of FIG. 1.

In FIGS. 1 and 2 an embodiment of the pallet according to the invention is shown. Certain components or constituent parts of the pallet according to the invention are preferably made from foldable sheet material, preferably paper, particularly corrugated paper or corrugated sheet (in addition to that, further components are also made from some kind of paper). The pallet according to the invention is therefore preferably a paper material pallet.

The special ability to withstand bending loads of this embodiment of the pallet according to the invention is due to outer and middle transverse stiffening profile elements arranged transversely with respect to the foot elements (and functioning as transverse stiffeners). The load bearing capacity is especially well-adjustable thanks to the profile elements (preferably formed by folding) applied in the structure. The structural stability of the profile elements increases together with the number of the folded-up mantle elements. In this embodiment the profile elements made from foldable sheet material are hollow closed profile elements (tube-like elements that have both their ends open and all their side walls closed, i.e. the elements do not have an "empty" side). The profile elements made from foldable sheet material by folding, i.e. the sheet material (skirt) is folded (wound) to a closed shape, the profile elements being completed by fixating this closed shaped by adhesive bonding of the sheet material or by other means. The profile element is thus folded up (wound up) such that—in order to allow for applying adhesive to the surfaces—a side or certain sides of the profile element is/are composed of more than one layer (i.e. to be overlapped; see in more detail below in the section describing the embodiments of the profile elements).

The foldable sheet material is preferably paper, particularly preferably corrugated paper (corrugated sheet), but sheets made of plastic can also be applied as foldable sheet material. The pallet is preferably assembled applying adhesive bonding, especially at surface-to-surface connections, however—e.g. with plastic sheet materials—welding, soldering or another fixation method can also be applied for securing together the components.

The thickness of the foldable sheet material to be applied can also be chosen according to the needs or requirements. According to the invention the number of free edges in the pallet is reduced to the minimum (free edges are preferably covered by other components due to the special folded structure), the pallet preferably being reinforced at the locations utilized for strapping in order to protect the pallet structure from wear and tear. These considerations are presented in detail in the description of embodiments the pallet according to the invention.

In the embodiment shown in FIGS. 1 and 2 the pallet according to the invention comprises a cover element 12 being made (by folding) from foldable sheet material and having a load bearing surface 11 (load bearing side) and a bottom surface 13 (attachment side) being opposite the load bearing surface 11, and foot elements 10 (foot bodies, also made from foldable sheet material), each having a foot surface 15 being parallel with the foot surface 13, and side walls 17 connecting the foot surface 15 and the bottom surface 13, the foot elements 10 are connected to the bottom surface 13. The longitudinal axis of the foot elements 10 is therefore parallel with the load bearing surface 11 (and, of course, with the bottom surface 13 forming the other side of the particular component). Due to their arrangement, the foot elements 10 perform the function of providing support to the cover element 12.

As with most known pallets, in the illustrated embodiment the pallet has three foot elements. If, however, a special-use pallet capable of providing two-sided support is envisioned, the middle leg (foot element) can also be omitted. The foot elements 10 of the pallet are arranged parallel with one another. In the context of the present application the term "parallel arrangement" is of course taken to refer to an arrangement that is parallel to a good approximation.

The distance between the bottom surface 13 and the foot surface 15 is of course identical for all foot elements 10. The foot elements 10 are also made from foldable sheet material. The mutually facing side walls 17 of the adjacent foot elements 10 are parallel with each other. With side walls of such configuration, profile elements having an end portion perpendicular to their respective principal axis (the axis interconnecting the two open ends of the profile elements) will provide shape fitting (shape/form closing) with the side walls.

Further, in this embodiment the foot surface 15 is configured in a material-continuous manner along its entire length, i.e. there are no interruptions or cutouts in the foot surface 15, the foot surface 15 is a continuous rectangle. The foot surface 15 is shown in FIG. 2. The foot surface 15 of each of the three foot elements 10 of this embodiment is materially continuous. In FIG. 2 support elements 14 (support studs, studs) arranged in the foot elements 10 at the ends of the foot element 10 and between the through openings 18 are shown. During the assembly of the foot element 10 the support elements 14 can be arranged at these locations in order to reinforce the foot element 10 (i.e. to increase the loading capacity of the pallet).

In this embodiment the pallet further comprises outer stiffening profile elements 16 that are arranged at each extremity of the cover element 12, are supported at their ends against mutually facing side walls 17 of adjacent foot elements 10 and are made from foldable sheet material, at least one (in this embodiment, two pairs of) intermediate transverse stiffening profile element(s) 20 arranged between the outer transverse stiffening profile elements 16 (in this embodiment, arranged to be supported in pairs). The central stiffening element 25 comprises at least one intermediate transverse stiffening profile element 20 being supported against the foot elements 10 adjacent thereto by its ends and being arranged between the outer transverse stiffening profile elements 16. In this embodiment, furthermore, outer transverse stiffening profile elements 16 being perpendicular to the longitudinal direction of the foot elements 10 are arranged on the bottom surface 13 of the cover element 12 at the edges (extremities) of the cover element 12 (if the longitudinal stiffening profile elements 22 also form a part of the central stiffening element 25, then the latter is supported also against the outer transverse stiffening profile elements 16). In this embodiment, furthermore, the outer transverse stiffening profile elements 16 are supported against the side walls 17 of adjacent foot elements 10 (in contrast to the outer transverse stiffening profile element 68 shown e.g. in FIG. 22 they are not full-width elements), and thus at each longitudinal edge of the pallet there is arranged as many of them as there are central stiffening elements; due to the dimensioning the outer transverse stiffening profile elements 16 can also be called inter-foot element (inter-leg) outer transverse stiffening profile elements 16.

The profile elements 16, 20 are therefore supported by their ends against the oppositely situated side walls 17. The ends of the profile elements 16, 20 are perpendicular to their axes. Such a support arrangement can preferably be provided in case the axis of the profile elements 16, 20 is perpendicular to the side wall 17. Since the profile elements 16, 20 are supported against the side wall 17, according to the above it is specified that they are arranged along the side wall 17. In addition to that it is also specified that the outer transverse stiffening profile elements 16 are arranged at the extremities of the cover element 12, i.e. where the side wall 17 and the edges of the pallet meet. As shown by the figures, according to this arrangement in this embodiment the outer transverse stiffening profile elements 16 are arranged at the shorter side of the pallet. In the illustrated embodiment— also as a result of making the pallet components by folding—the rectangle- or square-based block shaped profile elements 16 are arranged such that one of their sides, together with the covering sheets 26*a*, 26*b*, constitutes the shorter side of the pallet.

In addition to the rectangular or in special cases, square, cross section the profile elements may also have a triangular or circular cross section, however, profile elements with four sides folded at right angles are most preferably applied (such an element can be formed of more than four mantle elements, see below). With such profile elements, the region encompassed by the profile element in the direction perpendicular to the longitudinal axis is of rectangular (square) cross-section, as well as the outline of the profile element. Since one of the walls of the profile element is preferably a doubled (with two layers of sheet material), the encompassed region and the outline are preferably not congruent rectangles. Of course, here the "rectangular outline" of the cross section is taken to mean that the smaller manufacturing and folding inaccuracies are disregarded (e.g. if the two sides of the profile element folded over each other do not accurately overlap each other, or the corners of the preform applied for folding are cut). The closer the cross-sectional shape is to square, the higher stability is provided by the profile element, as the sides (mantle elements) thereof are equally strong (i.e. none of them can be deformed easier than any other).

Because the outer transverse stiffening profile element 16 is supported against the side wall 17 and is arranged at an edge of the cover element 12, it is also specified that the foot element 10 having the side wall 17 extends as far as the edge of the cover element 12. In this embodiment, furthermore, the outer transverse stiffening profile elements 16 are made, by folding, integrally with the cover element 12 from the material thereof the cover element 12. The outer transverse stiffening profile elements can be made as separate pieces, however that is less practical.

To sum up, in the embodiment according to FIGS. 1 and 2 the pallet comprises a cover element having a load bearing surface and a bottom surface being opposite the load bearing surface, as well as foot elements, each having a foot surface being parallel with the bottom surface and side walls connecting the foot surface and the bottom surface, the foot elements being connected to the bottom surface, wherein the side walls facing to each other of adjacent foot elements are parallel with each other, and the foot surface is formed in a material-continuous manner along its whole length. The pallet further comprises outer transverse stiffening profile elements being arranged at each extremity (edge) of the cover element, and being supported by their ends against the side walls facing to each other of adjacent foot elements, and at least one intermediate transverse stiffening profile element being arranged between the outer transverse stiffening profile elements, a height of the outer transverse stiffening profile elements and a height of the intermediate transverse stiffening profile element measured from the bottom surface are identical with each other, and the cover element, the foot elements, the outer transverse stiffening profile elements and the intermediate transverse stiffening profile elements are made from foldable sheet material.

Furthermore, in the embodiment of the pallet according to the invention shown in FIG. 1 the height of the outer transverse stiffening profile elements 16 and the height of the intermediate transverse stiffening profile element 20 measured from the bottom surface 13 are preferably identical with each other. Thus, the profile elements 16 and 20, shown by way of example in FIG. 2 all have identical height.

Subassemblies and constituent parts are illustrated in FIGS. 3-12 and are described with reference to these figures. The subassemblies are shown in FIGS. 13-16 in exploded drawings that are applied in order to better illustrate the interrelations and the arrangement of the subassemblies.

In FIG. 1 therefore a view of an embodiment of the pallet according to the invention is shown. In this view the pallet is shown from a slightly elevated perspective, with the cover element 12 being shown particularly clearly, and the foot elements 10 being shown from the side. In FIG. 1 through openings 18 arranged in the foot elements 10 are also shown. Through openings are typically arranged in pallets because the pallets can be most expediently lifted by a forklift fork (fork of a lifter mechanism or lifter vehicle) inserted in such openings. Accordingly, in this embodiment of the pallet according to the invention there are formed through openings 18; with two openings being arranged in each foot element 10 as with a typical, generic pallet configuration. A forklift fork can be inserted below the pallet also in a direction parallel with the foot elements in order to lift the pallet (if through openings are present, a so-called four-way lifting is possible, while if the fork can be inserted only in a direction parallel with the foot elements then only a so-called two-way lifting is possible). In pallets designed exclusively for the latter use (and in other similar cases), through openings need not be arranged.

In the illustrated embodiments of the invention, therefore, two through openings 18 extending between the side walls 17 of the respective foot element 10 are formed in each foot element 10, a distance between the through openings 18 and the bottom surface 13 is identical to a height of the intermediate transverse stiffening profile element 20 measured from the bottom surface 13, and at least one respective intermediate transverse stiffening profile element 20 is arranged at each through opening 18. This configuration is advantageous for strapping (see below). The through openings 18 can of course be configured differently; i.e. if through openings 18 are arranged it is not absolutely required to arrange the intermediate transverse stiffening profile elements 20 exactly in this manner. As it will become apparent below, in an embodiment of the invention one side of the foot profile element 38 is situated at this level defined by the through openings 18. For strapping it is not absolutely required to arrange such foot profile elements 38, i.e. with a through opening 18 of appropriate height there is not necessarily arranged a component with the above amount of hang or a differently configured component having the same hang can also be arranged.

As illustrated in the figures, in adjacent foot elements 10 the through openings 18 are formed at an equal distance from the edge of the cover element 12.

In the case of pallets, the through openings of the foot elements are of course configured such that they are situated in line with one another in the foot elements that typically have the same length (the foot elements typically have an oblong shape). The through openings of course have identical longitudinal dimensions. This configuration is necessitated by simple practical reasons, by way of example that the forklift fork can be relatively freely arranged inside the openings, allowing for multiple grasping positions.

The through openings 18 are therefore adapted to interconnect the two oppositely situated side walls 17 of the foot elements 10. At the opposite side of the foot elements 10, the part of the foot elements forming the foot surface 15 can also be observed in FIG. 1. The reinforcing applicable to this component (also shown in FIG. 1) will be addressed later on. In FIG. 1 a side covering sheet 24 (side protrusion or tab)

folded downwards on the side wall 17 is also shown. In the following the configuration of the covering sheet 24 is described; it preferably forms a part of the cover element 12, i.e. it is made by folding from the preform thereof, followed by fitting it into place.

FIG. 2 shows an underside view of the pallet, making observable the outer transverse stiffening profile elements 16 and also the intermediate transverse stiffening profile elements 20. These outer and intermediate transverse stiffening profile elements 16, 20 are arranged transversely with respect to the foot elements 10 (such that they are supported against the side wall 17 thereof). As illustrated in FIG. 2, in this embodiment (with three foot elements 10 arranged) four outer transverse stiffening profile elements 16 are arranged, along with four pairs of intermediate transverse stiffening profile elements 20. In the arrangement shown in the figure (i.e. at the ends of the foot elements 10 plus in two groups arranged at equal intervals between the ends) the profile elements 16, 20 particularly preferably provide transverse stiffening (improve transverse rigidity).

Thanks to the arrangement of the through openings 18 and intermediate transverse stiffening profile elements 20 at equal intervals (and, of course, to the longitudinal dimensions of the through openings), a respective pair of profile elements 20 is arranged at each of the through openings 18.

In this application the profile elements arranged transversely (perpendicular) with respect to the foot elements 10 are called "transverse stiffening profile elements". The longitudinal axis of the transverse stiffening profile elements is therefore perpendicular to the longitudinal axis of the foot elements 10. The longitudinal stiffening profile elements 22, largely obstructed from view in FIG. 2, have their longitudinal axis set parallel with the longitudinal axis of the foot elements 10. In views shown in further figures, such as in most of FIGS. 17-21, the longitudinal stiffening profile elements 22 arranged in this embodiment are less obstructed from view. The longitudinal stiffening profile elements 22 are supported by their ends against first profile elements 16, 20 (i.e. against the side wall thereof).

In an embodiment of the pallet according to the invention, therefore, longitudinal stiffening profile elements 22, made from foldable sheet material, are arranged between the outer transverse stiffening profile elements 16 and the intermediate transverse stiffening profile elements 20 adjacent thereto and/or between respective intermediate transverse stiffening profile elements 20 arranged at the through openings 18, the longitudinal stiffening profile elements 22 are supported by their ends against corresponding first profile elements 16, 20.

Longitudinal stiffening profile elements can be optionally applied in case it is required to improve load bearing capacity. The application of longitudinal stiffeners has a dual purpose. Firstly, it prevents the pallet according to the invention from "buckling". When a load is being lifted, the moving cargo exerts a side-direction force on the transverse stiffeners, especially if the load "swings", which may result in the displacement, deformation, shear or "buckling" of the transverse stiffener. The longitudinal stiffener prevents that, as—thanks to the shape fitting—it preferably does not allow the deformation of the transverse stiffening profile elements. On the other hand, according to the above described features of the transverse stiffeners, at the intersection plane of the longitudinal and transverse stiffeners a shape fitting is brought about by the local centre of gravity due to the elongation of the paper material, which causes the longitudinal stiffener to behave as a one-support holder, thus increasing the load bearing capacity. Thanks to the above described arrangement of the profiled transverse and longitudinal stiffening elements, to a local compressive load the structure of the pallet reacts with "getting locked", i.e. the inside profile elements are prevented by the outside ones from "opening up" under a compressive load.

The longitudinal stiffening profile elements are preferably adhesively bonded to the cover (to the bottom surface of the cover element) between the outer transverse stiffening profile elements and the intermediate transverse stiffening profile elements (preferably, collectively speaking, between transversely extending closed profiles). The outer transverse stiffening profile elements can also be called the outside closing profiles of the cover element, because they are preferably made of the same material.

The longitudinal stiffeners are fitted against the side wall of the transverse stiffeners such that a shape fitting is establihed and that the surfaces of the longitudinal and transverse stiffeners facing in an opposite direction relative to the bottom surface lie in the same plane, whereby an identical strapping plane is also maintained.

Figures 3, 4, 5:
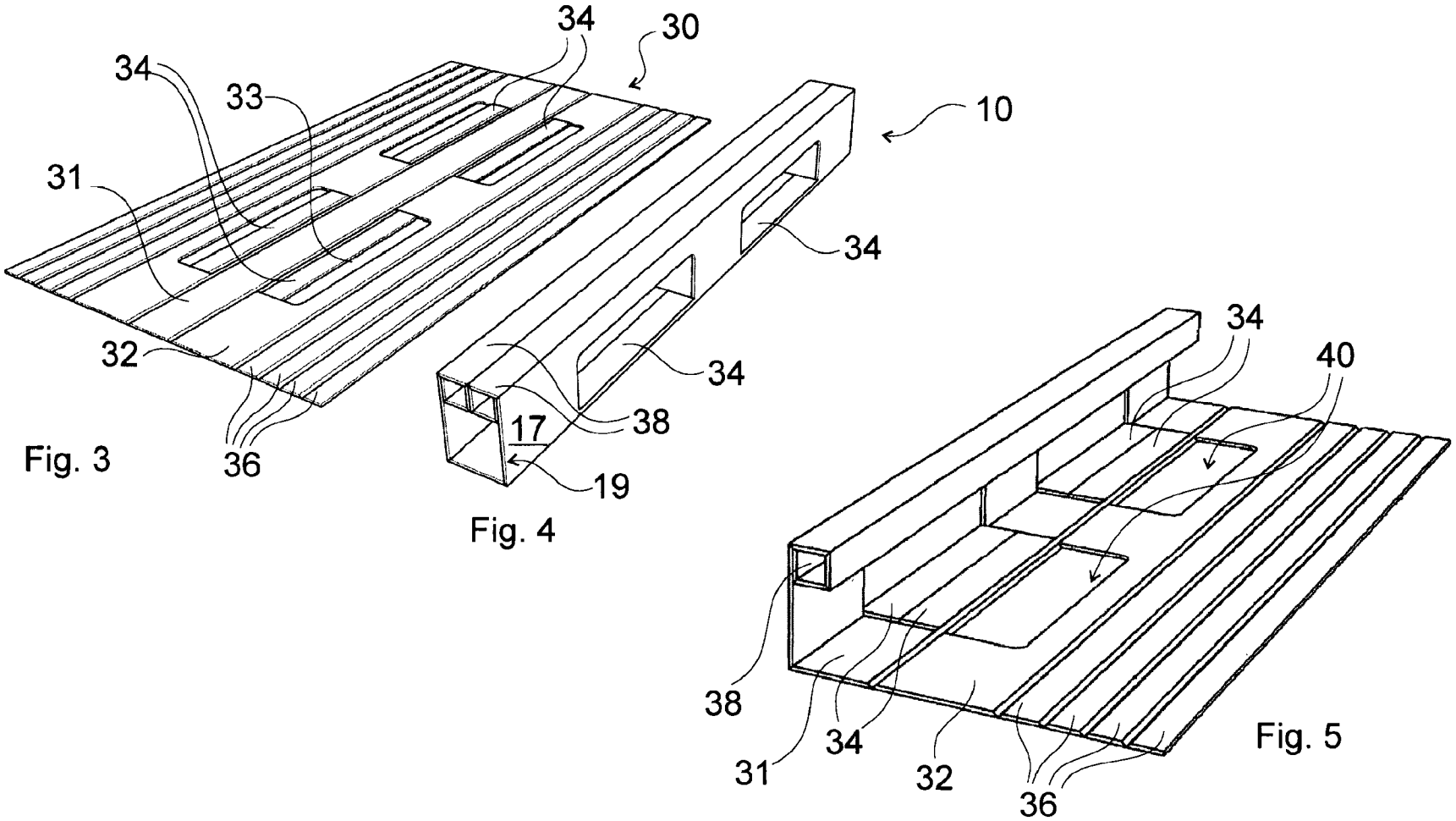
FIG. 3 illustrates a preform for the embodiment of FIG. 1 of the foot element.
FIG. 4 illustrates the foot element in the embodiment of FIG. 1.
FIG. 5 illustrates the foot element of FIG. 4 in a partly folded state.

In FIG. 3 a second folding preform 30 adapted for making the foot element 10 by folding is shown, while in FIG. 4 the foot element 10 is illustrated in a folded state. In FIG. 3 the second folding preform 30 is shown from a side in the direction of which the folds adapted to make the foot element 10 are to be made. This can be observed also from the impressed recesses, i.e. crease lines made in the folding preform 30 in order to facilitate folding that are shown in the top of FIG. 3. The figures show a pallet and its constituent parts made of corrugated paper sheet (i.e. applying corrugated paper as a foldable sheet material). The crease lines in the corrugated paper sheet can be made utilizing a tool with a blunt but relatively thin end, whereby recesses can be made in the undulations of corrugated paper without removing any material, exclusively by working the material utilizing the tool.

In FIG. 3 it is shown that around a first sheet 31 the other parts to be folded are arranged symmetrically. This first sheet 31 (i.e. the outside face thereof) forms the foot surface 15 of the foot element 10 (shown also in FIG. 2); accordingly, the first sheet 31 (and also the foot surface 15) has an oblong, rectangular shape.

At each longer side of the first sheet 31 a respective second sheet 32 adapted to constitute the side walls 17 by their outside faces in the folded state is connected. As the two side walls 17 of the foot element 10 are interconnected by through openings 18, a respective first opening 33 is formed in both second sheet 32. As shown in FIG. 3, a respective stiffening sheet 34 is arranged in each of the openings 33. Accordingly, the openings 33 formed in the folding preform 30 are not formed by removing all material from them, but by keeping the stiffening sheets 34 inside the openings 33 at the sides being at the first sheet 31, along its edges (besides that, in this embodiment, material is removed at the rounded-off corners of the first opening 33). As illustrated in FIG. 3, at the intersection of the first sheet 31 and the stiffening sheet 34 a folding edge is formed.

As illustrated also in FIG. 4, in the completed state of the folding preform 30, i.e. when the foot element 10 has already been made by folding from the preform, the stiffening sheets 34 are folded back on the first sheet 31. In order that the sheets 34, situated at both sides of the first sheet 31, can be folded onto the first sheet 31 at the same time (in a non-overlapping manner) the width of the stiffening sheets 34 is half the width of the sheets 31 (of course taking into account the width of both components as measured perpendicular to the longitudinal axis of the sheet 31). For establishing the exact dimensions, the folding edge between the first sheet 31 and the stiffening sheet 34 is of course also to be taken into account. By choosing the width dimensions in such a manner it can be provided that the sheets 34 are supported against each other at their closest edges in their folded-back state shown in FIG. 4. In addition to surface reinforcement, the foot surface 15 and the foot element 10 itself are thereby provided with further reinforcing. The folded-back stiffening sheets 34 are preferably adhesively bonded to the surface of the first sheet 31. Folding back the stiffening sheets 34 the through openings 18 are formed in the foot element 10, i.e. in the folded state of the component.

In this embodiment of the pallet according to the invention, therefore, the foot element 10 is formed from a second folding preform 30 comprising, for making through openings 18, first openings 33 and stiffening sheets 34, each of which is adapted to project into a respective first opening 33, by folding the stiffening sheet 34 back onto the side of the region corresponding to the foot surface 15 situated opposite the foot surface 15. The second folding preform 30 is of course made from a foldable sheet material as in this embodiment it is applied for making the foot elements 10. The stiffening sheet 34 can be folded back onto the foot surface 15 itself, however, according to the above it is more expedient to fold it onto the inside face because it would form an uneven surface region on the foot surface 15.

In the case of the foot surface 10 (leg), therefore, the bottom zone (the foot surface) is materially continuous, with the corrugated sheet (in the figures: the stiffening sheets 34) being preferably folded back along the entire length of the through opening (lifting opening), whereby a tensioned zone adapted to withstand the bending loads of the foot element 10 (leg) is formed and/or reinforced. By folding the sheet back some open edges are also removed.

First mantle elements 36 separated from one another by folding edges are connected at folding edges to the outside faces (i.e. the faces not connected to the first sheet 31) of the second sheets 32. As illustrated by FIG. 4, these first mantle elements 36 that have an oblong but still rectangular shape, are required for making a foot profile element 38. The foot profile element 38 can be obtained from the first mantle elements 36 by folding them in a manner illustrated in FIG. 4. Four mantle elements 36 are arranged at each side.

As shown in FIG. 4, the mantle elements 36 situated innermost in the folding preform 30 are situated in the folded state at the upper side of the foot element 10. This upper side of the foot element 10 is fixed (preferably via an attachment sheet 42 connected to the intermediate transverse stiffening profile elements 20 as described below) to the bottom surface 13 of the cover element 12. As four mantle elements 36 are arranged at each side, the next two mantle elements 36 will be supported against each other (if every mantle element 36 is folded to be perpendicular with respect to the previous one). After folding is completed, the third mantle elements 36 are arranged at the bottom of the row (facing the first side 31).

It is expedient to arrange the four mantle elements 36 at each side because in the folded state the fourth mantle element 36 is folded back such that it becomes arranged along the inside face of the side wall 17. This mantle element 36 is preferably adhesively bonded to the inside face of the side wall 17, while the mantle elements 36 (second in the row) that are supported against one another in the folded state are preferably adhesively bonded to one another.

In the illustrated embodiment, by adding up the thickness of a sheet (for example, the second sheet 32 constituting the side wall 17) to the (thickness of the) upper mantle elements 36, essentially the width of the stiffening sheets 34 is obtained (in accordance with the requirement that the two sheets 34 should span the first sheet 31, while the two mantle elements 36 should span only the distance between the two side walls 17, i.e. a distance smaller by two wall thicknesses).

Furthermore—as shown in FIG. 1—in the illustrated embodiment the width of each mantle element 36 is approximately the same as the distance between the innermost mantle element 36 and the opening 33. The width of the mantle elements 36 oriented vertically in the folded state is chosen such that, in the folded state, the foot profile element 38 extends as far as the through opening 18. Thus, the foot profile element 38 provides the foot element 10 with the greatest possible amount of stiffening (since it has the greatest possible cross-sectional area), while it does not project into the through opening 18 and does not obstruct the movement of the forklift fork projecting therein while cargo is moved.

As illustrated also in FIG. 3, the first sheet 31, the second sheet 32 and the mantle elements 36 have identical longitudinal dimensions (measured in the longitudinal direction of the foot element 10).

In FIG. 5 the second folding preform 30 is shown in a partially folded state. In the partially folded state illustrated in FIG. 5 the stiffening sheets 34 have already been folded back onto the first sheet 31 (and are preferably adhesively bonded thereto). FIG. 5 illustrates that the first sheet 31 is reinforced by the stiffening sheets 34 across a very large, extensive surface area.

In FIG. 5 the mutual arrangement options of the support elements 14 (described in detail later on) and the stiffening sheets 34 are also illustrated. In FIG. 5 a foot profile element 38 can be also observed, since only one of these components has yet been folded. In this embodiment the pallet comprises a foot profile element 38 being formed from foldable sheet material, being arranged at the side of the foot element 10 facing the bottom surface 13 (and is preferably formed integrally with the foot element 10), and has a height measured from the bottom surface 13 identical to the distance of the through openings 18 measured from the bottom surface 13. A foot element 60, illustrated for example in FIG. 22, is also configured in the manner shown in FIGS. 3-5, but the foot element 60 is shorter relative to the covering sheet 62, while the foot element 10 extends essentially along the entire length of the covering sheet 12. Otherwise the above description of features of the foot element 10 applies also to the foot element 60.

Figure 12:
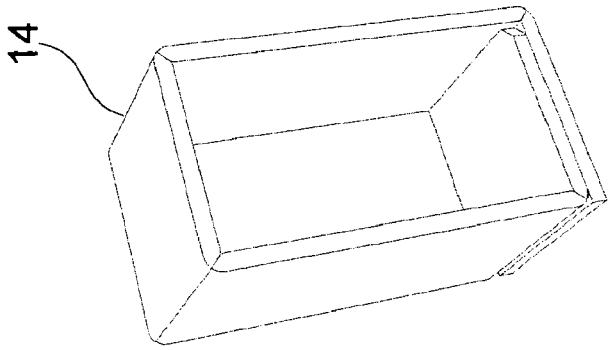
FIG. 12 illustrates a support element to be applied in the foot element in an embodiment.

As with the other profile elements—as illustrated also in FIG. 12—the support elements 14 are folded to a rectangular block shape applying a folding preform. As illustrated also in the exploded figures of FIGS. 13-16, the rectangular block-shaped support elements 14 are supported against the rear edge of the foot surface 15 and the foot profile elements 38 at their empty sides (i.e. the ends of the profile elements). In order to achieve the most favourable effect possible, the profile elements making up the support elements 14 are implemented such that the length of their sides conforms to the specified dimensions as accurately as possible, i.e. that the support elements 14 can fit tightly in the chamber prepared for them. The support elements 14 are preferably dimensioned such that their empty sides (profile ends) fit between the end of the foot element 10 and the folded stiffening sheets 34, and in the middle, between the two through openings 18, between the stiffening sheets 34. Then, they are preferably unable to move in the longitudinal direction of the foot element 10. The pallet is preferably dimensioned such that support elements 14 of identical size can be arranged therein.

Figure 6:
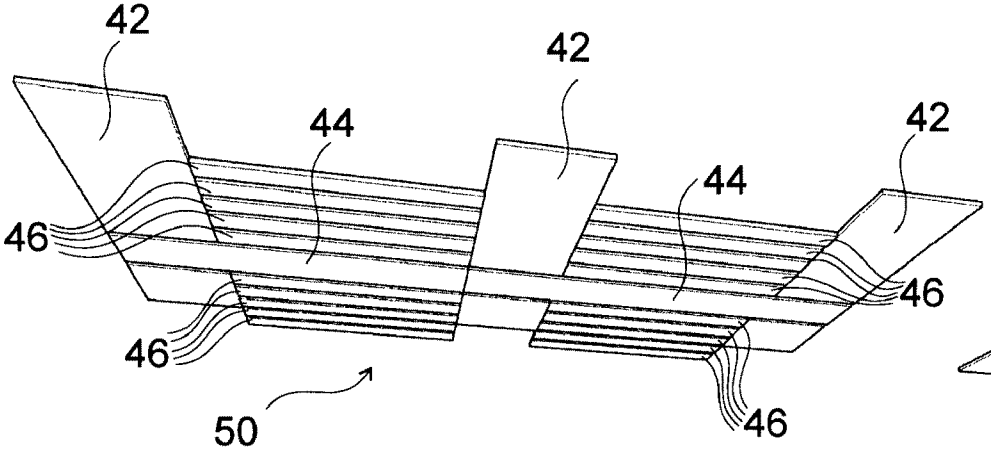
FIG. 6 illustrates a folding preform for the intermediate transverse stiffening profile elements.

In FIG. 6 a first folding preform 50 is illustrated. As it is apparent from the folded state of the first folding preform 50 shown in FIG. 7, in the embodiments described above, the intermediate transverse stiffening profile elements 20 are prepared from this preform.

Figure 7:
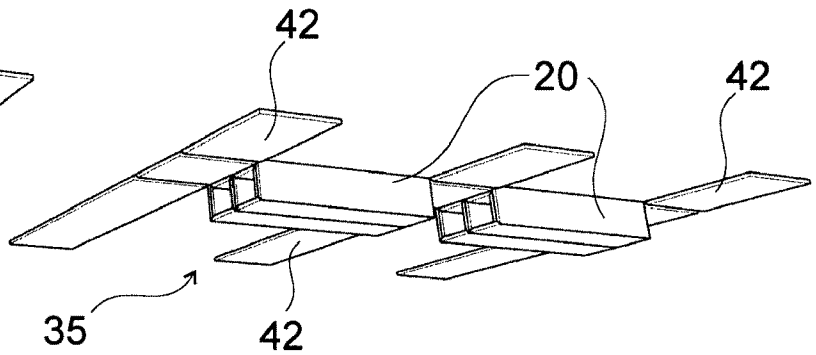
FIG. 7 illustrates in its completed state the element folded from the preform of FIG. 6.

In FIG. 6, therefore, the configuration of the first folding preform 50 is illustrated in an embodiment. In this embodiment, four intermediate transverse stiffening profile elements 20 (two pairs) can be prepared from a single folding preform 50, as it is also illustrated in FIG. 7. Accordingly, in order to produce the embodiments illustrated in FIGS. 1 and 2, two such first folding preforms 50 have to be used. The arrangement of the preforms (along the longitudinal direction of the foot elements 10, i.e. that of the pallet itself) is illustrated by exploded drawings in FIGS. 13-16.

As illustrated in FIG. 6, in an embodiment there is arranged at least one pair of intermediate transverse stiffening profile elements 20 (in the embodiment illustrated in FIGS. 1, 2 there are arranged four pairs of such profile elements), which are supported against one another at their sides, and are made from a first folding preform 50, the first folding preform 50 comprising an interconnection element 44 having parallel longitudinal sides (the longitudinal sides extending between the ends of the oblong interconnection element 44), and a respective intermediate transverse stiffening profile element preform portion connected to each of the longitudinal sides of the interconnection element 44, the preform portions being adapted for forming an intermediate transverse stiffening profile element 20. Therefore each of these intermediate transverse stiffening profile element preform portions is adapted for making a single intermediate transverse stiffening profile element 20. The intermediate transverse stiffening profile element preform portion is not shown separately in the figure; in the embodiment illustrated also in FIG. 6 the preform portion is constituted by five second mantle elements 46, of which a single intermediate transverse stiffening profile element 20 is formed.

In the embodiment illustrated also in FIG. 6 the first folding preform 50 further comprises attachment sheets 42 (connection sheets) that are situated at the connection of the foot elements 10 and the bottom surface 13 such that they are to be arranged between them, and are connected to the extremities of the edges of the interconnection element 44. In the preferred configuration shown in FIG. 6 two interconnection elements 44 are arranged, with a common attachment sheet 42 being connected to the first end of each, and with a separate attachment sheet being connected to the second end of each sheet. The number of attachment sheets 42 arranged in the first folding preform 50 corresponds to the number of the foot elements 10. According to this configuration the first folding preform 50 and the attachment sheet 42 are made from foldable sheet material.

It is thus apparent that, as in the embodiment of FIG. 6 the first folding preform 50 contains material sufficient to form two pairs of intermediate transverse stiffening profile elements 20 (see in FIG. 7 an intermediate element 35 obtained from the first folding preform 50) in this embodiment two interconnection elements 44 are arranged. Attachment sheets 42 are arranged at both ends of the oblong interconnection elements 44, however—as illustrated in FIG. 6—the attachment sheet 42 arranged between the two interconnection elements 44 is a common one. This can also be understood in the light of the fact that one attachment sheet 42 corresponds to each foot element 10, so three attachment sheets 42 should be arranged for the three foot elements 10 of the embodiment of FIGS. 1 and 2. The fold lines that can be seen in the attachment sheets 42 do not play any role (it thus is not necessary to weaken them) since, as it is also shown in FIG. 7, the attachment sheets 42 are not folded.

In the embodiments illustrated in FIGS. 6 and 7, therefore, the outer transverse stiffening profile elements 16 and the intermediate transverse stiffening profile elements 20 have a rectangle based (approximately square-base) block (prism) shape, and are formed of five mantle elements 46, 52 by applying folding at the lines between the mantle elements 46, 52 such that the mantle elements 46, 52 overlap along at least one mantle element 46, 52 of the profile element 16, 20. To obtain the near-square based block shape, the sheets have to folded at right angles. In this embodiment the profile elements 20 have a rectangular-base (near-square based) straight block shape. The lateral sides (mantle elements) of the block are preferably dimensioned bearing in mind that there should be no collisions between the mantle elements when they are folded (wound up), i.e. for example, after folding is completed, the first and the fifth mantle element are aligned with each other to a good accuracy.

The reason why it is expedient to apply a preform consisting of at least five mantle elements 46 at both sides of the interconnection element 44 for making the profile elements 20 is that in that case, in a manner illustrated also in FIG. 7, in each pair of profile elements 20 made by folding, two mantle elements 46 (one of each profile element) will be supported against each other. A further mantle element 46 of each member of the pair will be seated on the interconnection element 44 (being preferably adhesively bonded thereto), while the outermost of the five mantle elements 46 will be seated on the inside face of the innermost mantle element 46, i.e. the one that is connected to the interconnection element 44, to which it is preferably also adhesively bonded. Accordingly, applying five mantle elements 46 an intermediate transverse stiffening profile element 20 having exceptionally high stability can be prepared; the structure can be reinforced even further by adding further mantle elements 46. The rectangular cross section of the block shape (i.e. its near-square sectional shape) does preferably not change in case of adding more than five mantle elements, the additional mantle elements can essentially be folded further along a helical path towards the centre of the block.

Figures 8, 9:
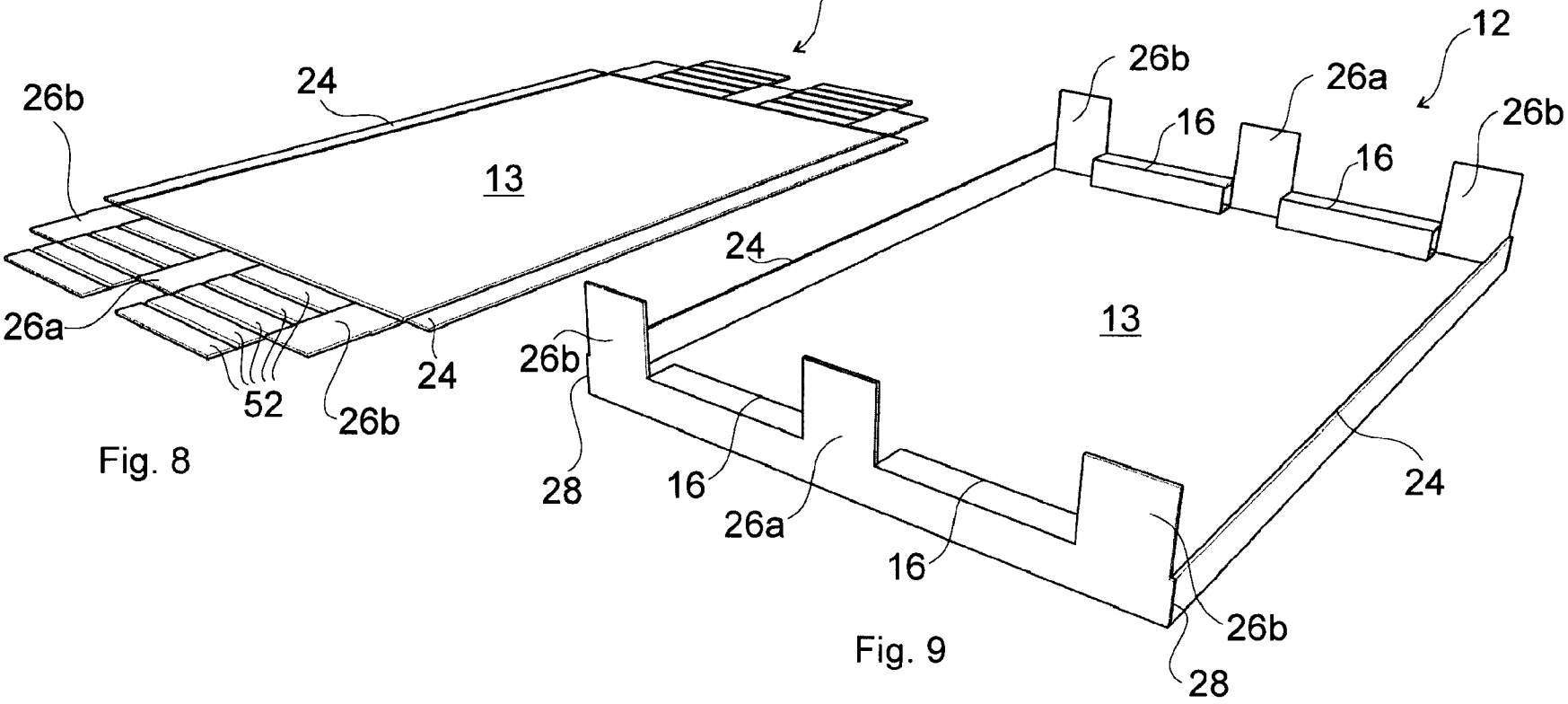
FIG. 8 illustrates a folding preform for the cover element.
FIG. 9 illustrates an embodiment of the finished cover element.

In FIG. 8 a third folding preform 54 adapted to prepare the cover element 12 is shown. In the view of the figure, the underside of the folding preform 54 can be seen, the majority of the visible surface area being accordingly taken up by the bottom surface 13. It is illustrated in FIG. 8 that the third folding preform 54 comprises several additional portions that can be cut out from a flat sheet together with the bottom surface 13 and are connected to the sheet from which bottom surface 13 is made along a respective folding edge (or are connected to such a subcomponent also along a folding edge).

In FIG. 9 a completely assembled state (folded and preferably adhesively bonded) of the folding preform 54 is illustrated. As it was discussed above—as with conventional pallets—the portion of the cover element 12 of which two sides are constituted by the load bearing surface 11 and the bottom surface 13 has a rectangular (or rectangular block, with a thickness corresponding to the sheet thickness) shape, i.e. it has a longer and a shorter edge. A respective side covering sheet 24 is arranged along the longitudinal edges. In this embodiment, therefore, the pallet comprises a side covering sheet 24 being formed integrally with the cover element 12 from the material thereof (in a materially continuous fashion), and being folded to the outer side walls 17 of the outer foot elements 10 as far as the through openings 18 (i.e. extending as far downwards as the through openings 18).

Due to this arrangement of the side covering sheet 24—as is generally the case with pallets—the outer foot elements are arranged along the longer side of the pallet, at the edges of the load bearing (loading) surface thereof, with the length of the foot elements preferably being identical to the longitudinal dimension of the pallet. The side covering sheet 24 arranged in this embodiment has the same length. The advantage of arranging the side covering sheet 24 is that it provides the outer foot elements 10 with additional reinforcement, and, since it is arranged such that its longitudinal edge (its free longitudinal edge, i.e. the one that is not connected to the bottom surface 13) extends along the upper edge of the through openings 18 (along their side facing the load bearing surface 11), also reinforcing said edge over which the straps laid preferably by automated strapping are bent. Strapping is passed through the through openings 18, of course encompassing the cargo situated on the pallet. Accordingly, the straps are also passed over and along the intermediate transverse stiffening profile elements 20 arranged at the through openings 18 that preferably also extend downwards as far as this height level (conforming to the distance between the through openings 18 and the load bearing surface 11), i.e. the straps can be tensioned over the intermediate profile elements 20 (straps can be tensioned to a greater extent compared to the case wherein the straps could not be supported against the profile elements 20).

In the pallet construction according to the invention, therefore, transverse stiffening is provided for in a unique manner (e.g., as put forward above, by applying outer and intermediate transverse stiffening profile elements or other central stiffening elements), which results in that the strapping plane is the same in the longitudinal direction of the pallet, and preferably also in a direction transverse to that. Such a configuration of the transverse stiffener results in improved bending strength because the portion seated on the leg improves the second order momentum.

The structural implementation of the transverse stiffener improves cross loading capacity (load bearing capacity for loads with a centre of weight located between the foot elements), and at the same time it reduces bending load under the same load (i.e. it improves load bearing capacity) thanks to the fact the load is transferred to the side wall (skirt) of the foot elements due to the shape fitting of the profile element (preferably, a closed profile or other central stiffening element) arranged between the foot elements (legs). This is due to the fact that—as described in detail above—a shape fitting is brought about around the local centre of weight thanks to the elongation of the paper material, which causes the closed profile to behave as a one support holder, partially relieving the foot element of vertical loads. Measurement results of our experiments have indicated that the inclusion of the outer and intermediate transverse stiffening profile elements improved bending load bearing ability by 25% relative to a structure wherein no such elements are arranged. In addition to that, the outer transverse stiffening profile elements and the intermediate transverse stiffening profile elements (collectively referred to as transverse stiffeners) provide that the pallet can be lifted at the longer side as they can be supported by the forks of a forklift and thus allow the pallet to be lifted.

A strapping plane is provided for longitudinally extending straps by the outer and intermediate transverse stiffening profile elements 16, 20, as they have an identical amount of projection as measured from the bottom surface. This strapping plane can be complemented assisted by the longitudinal stiffening profile elements 22 (described later on) because—as it is discussed below—they preferably also have the same amount of projection as defined by the profile elements 16, 20, and thus the straps can be passed on them, too.

Strapping is preferably carried out applying plastic straps that are folded at the location where the edges of through opening 18 and the side covering sheet 24 are aligned. Accordingly, less damage can be done to this edge by tightly tensioned strapping. Highly tensioned strapping is widely applied for storing and stocking goods. In many cases, strapping is applied for goods stored in corrugated paper boxes. Strapping typically cuts into the outermost boxes in such cases.

The above described arrangement of the side covering sheet 24 helps prevent or reduce this effect. Providing reinforcement applying the side covering sheet 24 therefore contributes significantly to allowing the prolonged use of the pallet.

In FIG. 8 a preform portion adapted for forming the outer transverse stiffening profile elements 16 (with the appropriate crease lines) is also shown. In the illustrated embodiment the pallet comprises three foot elements 10, with two outer transverse stiffening profile elements 16 being arranged in each of the intervals between the foot elements 10 (that is, in total four profile elements 16 are arranged). Accordingly, the folding preform 54 comprises at each of its shorter sides—separated from the other portions of the folding preform 54 by folding edges—a preform portion adapted for making two outer transverse stiffening profile elements 16. Between the interconnection lines of these preform portions, as well as at the two extremities of the shorter sides there are arranged covering sheets 26*a*, 26*b*, the role of which will be discussed later on.

The preform portion adapted to prepare the outer transverse stiffening profile elements 16—like the preform portion corresponding to the intermediate transverse stiffening profile elements 20—comprises five third mantle elements 52.

The preform portions of the profile elements may also comprise more than five mantle elements; in which case the mantle elements are folded along the above presented principles, while the sixth and other mantle elements are folded further inwards along a helical-like path such that more and more side sheets of the profile element receive reinforcement from the inside, i.e. the entire profile element is reinforced more and more.

In this case—in the folded state shown in FIG. 9—the mantle elements 52 of the profile elements 16 are arranged as follows. The mantle element 52 situated closest to the bottom surface 13 is folded up such that it is at a right angle relative to the bottom surface 13 (as illustrated in FIG. 9, the covering sheets 26*a* and 26*b* are also folded at such angle). The next mantle element 52 is folded by another 90° (the angles may vary slightly depending on how the sheets can be accommodated), so that in the folded state it is parallel with the bottom surface 13. In the folded state, the third mantle element 52 will be parallel with the first mantle element 52, while the fourth mantle element 52 is folded inwards beside the bottom surface 13 and is preferably also adhesively bonded thereto. Accordingly, the fifth mantle element 52 is folded back onto the first mantle element 52 from the inside, providing it and the entire profile element 16 with further reinforcement. The first and the fifth mantle element 52 may be preferably secured together by adhesive bonding.

During assembly, the outer transverse stiffening profile elements 16 configured in such a way will be situated right between two foot elements 10, and in the assembled state the profile elements 16 will be supported at their ends against them. To achieve that, it is of course also required that the dimensions of the foot elements 10 are consistent with the dimensions of the profile elements 16 and the other components.

The covering sheets 26*a*, 26*b* are dimensioned such that they cover the end portions of the foot elements 10 placed into their right place. This can be observed e.g. in FIGS. 1 and 2 illustrating the assembled state, as well as in other figures described later on. In this embodiment, therefore the foot elements 10 have end portions 19 being perpendicular to the side walls 17 and to the foot surface 15, and the pallet further comprises covering sheets 26*a*, 26*b* being formed integrally with the cover element 12 of the material thereof, and covering the end portions 19 of the foot elements 10. The end portion 19 is indicated in FIG. 4, it is practically formed by the end of the oblong (rectangular block-shaped) foot element 10 that does not have any covering surface made of the material of the foot element 10 but is preferably covered by the first and second covering sheets 26*a* and 26*b*. The outer covering sheets 26*b* preferably comprise a projecting portion 28. The projecting portion 28 is a rectangular extension portion arranged at the outside face of the covering sheet 26*b* and is adapted to cover the end of the side covering sheet 24 when it is folded to place. Applying the extension portion it can be achieved that—for example, with components made of corrugated paper—the internal structure of the side covering sheet 24 is not exposed and is thus protected from damage. Application of the extension portion is preferable for providing protection against water and humidity, and in addition it also provides mechanical protection for the ends of the side covering sheets 24, which also contributes to the improved reusability of the pallet.

The above described configuration of the cover element has the advantage that it closes off the (closed profile) frame produced by the profile elements (by means of the covering sheets 24, 26*a*, 26*b*), and besides that, by folding the back-folding covering sheets 26*a*, 26*b* (base- or leg tabs) and the side covering sheets 24 longitudinally onto the legs the pallet is kept together, with, in the case of bending loads, the role of the so-called "compressed zone" (compression zone) is also improved because the foot elements 10 are encompassed by the covering sheets.

Figure 10:
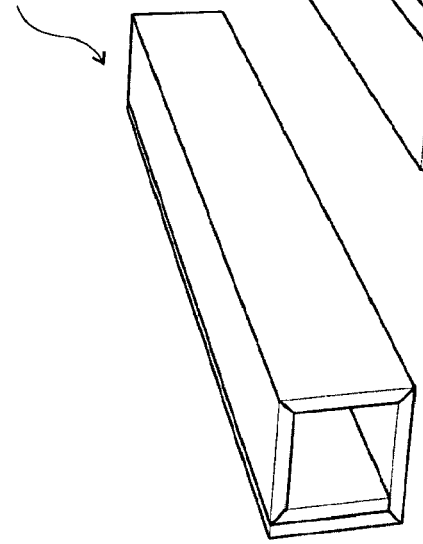
FIG. 10 illustrates the longitudinal stiffening profile element in an embodiment.

FIG. 10 illustrates the longitudinal stiffening profile element 22 that is also shown in FIG. 2 described above and can be even more clearly seen in the figures described later on and is adapted to be arranged in the longitudinal direction of the pallet; with each profile element 22 being supported at its end faces against the side wall of an outer transverse stiffening profile element 16 and an intermediate transverse stiffening profile element 20, respectively, or the side walls of two intermediate transverse stiffening profile elements 20.

Figure 11:
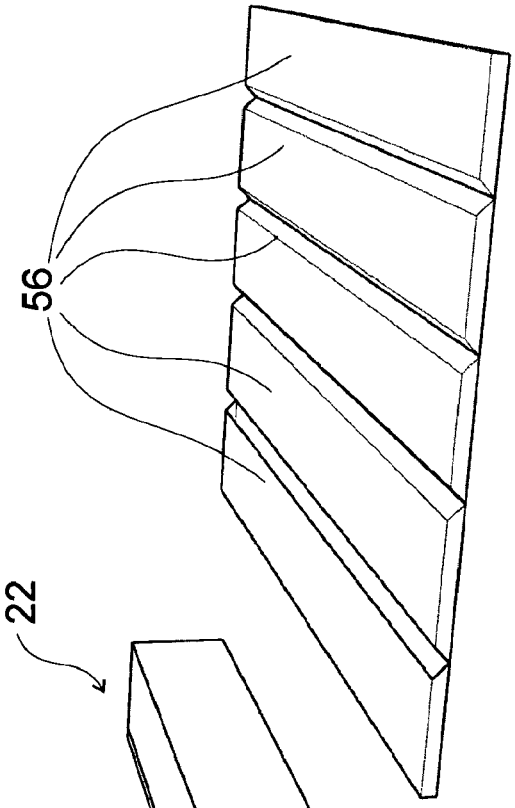
FIG. 11 illustrates a folding preform for the longitudinal stiffening profile element of FIG. 10.

As illustrated in FIGS. 10 and 11, in this embodiment (applied in the embodiments of the pallet illustrated in the other figures) the longitudinal stiffening profile element 22 has a rectangle (to a good approximation, square) based block shape, and is formed of five mantle elements 56 by applying folding at the lines between the mantle elements 56 such that the mantle elements 56 overlap along at least one mantle element 56 of the longitudinal stiffening profile elements 22. On one of the side walls of the profile element 22 (as with other profile elements) therefore the profile elements overlap, i.e. according to the folding pattern (each mantle element is folded at a right angle relative to the adjacent one) the first and fifth mantle elements are placed on each other (are parallel with each other), i.e. they are arranged under each other. These mantle elements can preferably be adhesively bonded to one another across the entire surface of the mantle elements. For dimensioning the requirement that after folding the sheets (mantle elements) located under each other should not collide with each other (which might happen if all mantle elements had the same width and their foldable sheet material was sufficiently thick) but should be placed underneath each other, can preferably be considered. Like in the above described cases, more than five mantle elements can be arranged in this case as well.

In FIG. 12 a support element 14 is shown applied in an embodiment. It is not mandatory but preferable to apply the support elements. The loading capacity of the pallet can be increased by the inclusion of support elements. As shown in FIG. 12, the profile element constituting the support element 14—just like other profile elements—is formed of five mantle elements, which results in two mantle elements overlapping across their entire surface (these mantle elements can be adhesively bonded together) As illustrated in FIG. 12, the corners of the outermost mantle element can preferably be cut off.

Figure 13:
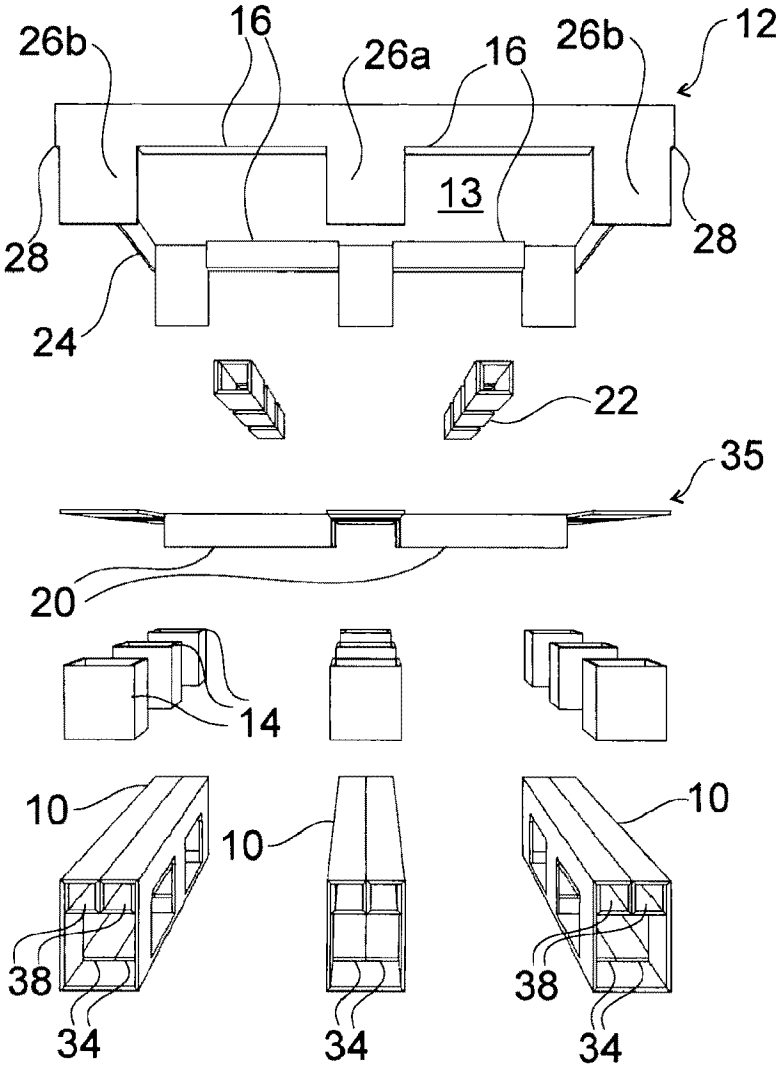

The configuration of the pallet according to FIGS. 1 and 2 is illustrated by exploded drawings in FIGS. 13-16. In FIG. 13 certain parts of the pallet are shown from the direction of the shorter side. The foot elements 10 are shown in their assembled state (the folded-in stiffening sheets 34 can also be observed in the figure). The support elements 14 (made from separate pieces) are arranged above the foot elements 10 in this figure (so that the internal structure of the foot elements 10 can be seen more clearly). The height of the support elements 14 (their vertical dimension in the figure) preferably equals—to the greatest possible accuracy—the distance between the bottom sheet of the foot element 10 and the profile elements 38. In an embodiment a size of the stiffening sheets 34 measured in the longitudinal direction of the foot surface 15 is the same as a respective size of the through openings measured in the same direction, and support elements 14 bordered by the foot profile element 38, the side walls 17, a region corresponding to the foot surface 15, and the ends of the stiffening sheets 34 being arranged inside the foot element 10. The support elements 14 are preferably also made from foldable sheet material.

In FIGS. 13-16 an intermediate element 35 (i.e. the first folding preform 50 in a folded state) is shown above the support elements 14. Being part of the central stiffening element, transverse stiffening profile elements 20, supported against the side wall of the foot element and seated on the cover, from the intermediate element 35 (performing, preferably in cooperation with the profile element 22 the function of a stiffening element); the attachment sheets 42 are adapted only for securing the profile elements 20. As shown, the intermediate transverse stiffening profile elements 20 are arranged in two rows, fitted between the foot elements 10. The longitudinal stiffening profile elements 22, also to be arranged in this embodiment, are depicted above the subassembly obtained from the first folding preform 50 (because four outer transverse stiffening profile elements 16 and four pairs of intermediate transverse stiffening profile elements 20 are arranged in this embodiment, there are produced six intervals between the transverse stiffening profile elements, six of such stiffening elements are applied). The cover element 12, obtained from the third folding preform 54, is located in FIG. 13 above the profile elements 22. It is illustrated by this arrangement that the covering sheets 26*a*,

26*b* are adapted for covering the end portions of the foot elements 10 in the assembled state.

Figure 14:
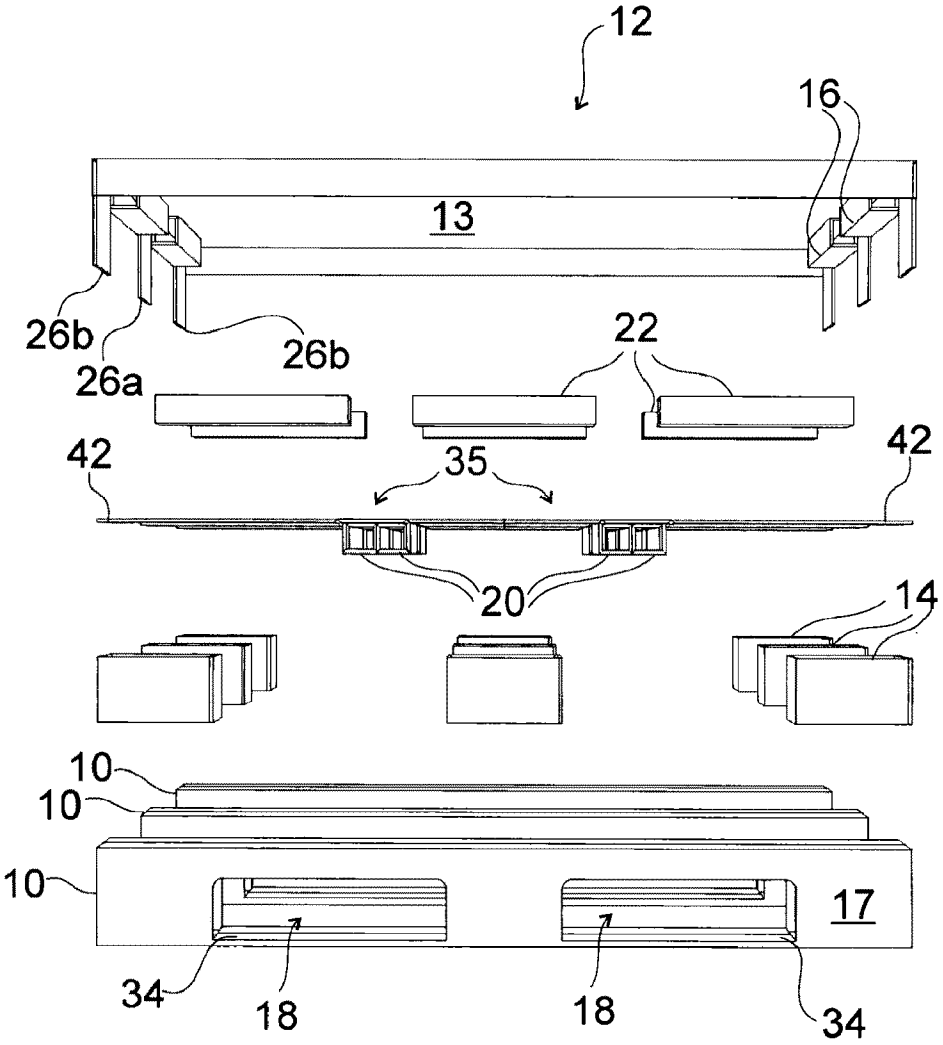
FIGS. 13-16 are exploded views of the embodiment of FIG. 1.

In FIG. 14 the components are illustrated in a side view, i.e. from the direction of the longitudinal side of the pallet, in an exploded drawing. As with FIG. 13, at the bottom of FIG. 14 the foot elements 10 are shown. On the foot element 10 at the front there can be seen the through openings 18, and at the bottom of the through openings 18 the folded-in stiffening sheets 34. As shown in FIG. 14, the length of the support elements 14 is preferably the same as the distance between the end of the foot element 10 and the through opening 18, and as the identical distance between the two through openings 18.

The purpose of arranging the support elements 14 (studs) is to improve static loading capacity, which capacity can be increased, if desired, by increasing the thickness of the material of the profile element (closed profile) forming the support element such that the bending core is wound multiple times.

As with FIG. 13, in FIG. 14 the intermediate elements 35, folded from the first folding preform 50 adapted for forming the intermediate transverse stiffening profile elements 20, are shown above the support elements 14. Since in this embodiment each intermediate element 35 comprises two pairs (i.e., in total, four) intermediate transverse stiffening profile elements 20, two intermediate elements 35 are required in order to obtain the eight intermediate transverse stiffening profile elements 20. As illustrated also in FIG. 7, the attachment sheets 42 have asymmetrical arrangement with respect to the interconnection element 44. As shown in FIG. 14, there are two attachment sheets 42 arranged along the length of the longitudinal side of the pallet. The two attachment sheets 42, arranged longitudinally one after the other, essentially make up the length of the pallet (i.e. the distance between two mutually facing covering sheets 26*b* on the cover element 12). As illustrated also in FIG. 14, the intermediate elements 35 are first placed in the cover element 12, followed by arranging the foot elements 10 (preferably, adhesive bonding is applied in both steps). According to the above, the position of the intermediate transverse stiffening profile elements 20 along the length of the pallet can be chosen by adjusting the length of the attachment sheets 42. As illustrated in FIG. 14, the division between the intermediate elements 35 is located in the middle of the figure. The attachment sheets 42 are arranged between the foot element 10 and the bottom surface 13, preferably secured there by adhesive bonding.

In FIG. 14 the position of the intermediate transverse stiffening profile elements 20 in respect to the through opening 18 is also shown (the assembled pallet is obtained by pushing together the components in the vertical direction of the figure). In FIG. 14 the longitudinal stiffening profile elements 22 are shown above the intermediate elements 35, the cover element 12 being shown above them. This figure also illustrates that in the assembled pallet the length (the dimension shown in the figure, i.e. the longitudinal extension) of the longitudinal stiffening profile elements 22 matches the distance between adjacent groups of intermediate transverse stiffening profile elements 20, as well as the distance between adjacent profile elements 16, 20. These distances, and so the length of all longitudinal stiffening profile elements 22, are identical.

FIG. 14 also illustrates the arrangement of two intermediate transverse stiffening profile elements 20 in each group. As it was touched upon above in relation to FIGS. 6 and 7, members of profile element 20 pairs are supported against each other (the mutually supported sheets are preferably also adhesively bonded together). Such a "double" arrangement of the intermediate transverse stiffening profile elements 20 improved rigidity may be achieved. In addition to that, as illustrated in FIG. 14, it is also preferred to form pairs of intermediate transverse stiffening profile elements 20 because of the arrangement of the attachment sheets 42 (around the interconnection element 44 forming a part of the first folding preform 50), since otherwise discardable excess material would be left over from the material of the first folding preform 50 between the attachment sheets 42. In the assembled state the profile elements 20 have to be arranged somewhere near the through openings 18, so in this embodiment the interconnection element 44 cannot be arranged e.g. at the ends of the attachment sheets 42.

Figure 15:
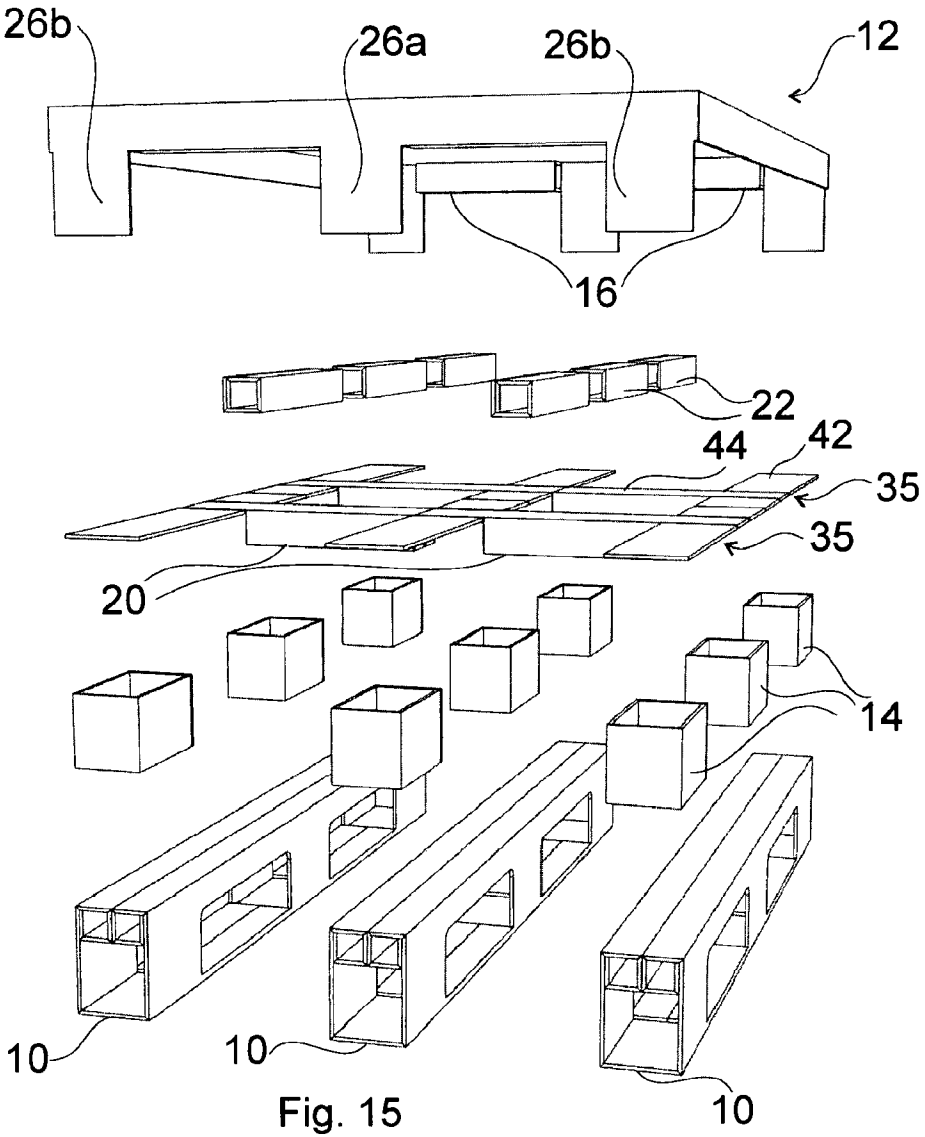

FIG. 15 shows another view of the pallet, illustrated in an exploded drawing. In this figure, the cover element 12, the longitudinal stiffening profile elements 22, the intermediate elements 35, the support elements 14 and at the bottom the foot elements 10 are shown under each other. The two central stiffening elements, formed by profile elements 20 and 22, can also be clearly seen in FIG. 15. In FIG. 15 the three longitudinal stiffening profile elements 22 and the transverse stiffening profile elements 20 located underneath them that are shown in the left and in the right of the figure correspond, respectively, to the first and second central stiffening element 25. The attachment sheets 42 applied in this embodiment facilitate the fixed arrangement of the stiffening elements 25. The profile elements 20 and 22, forming a part of the central stiffening elements 25, are shown also in FIG. 16.

Figure 16:
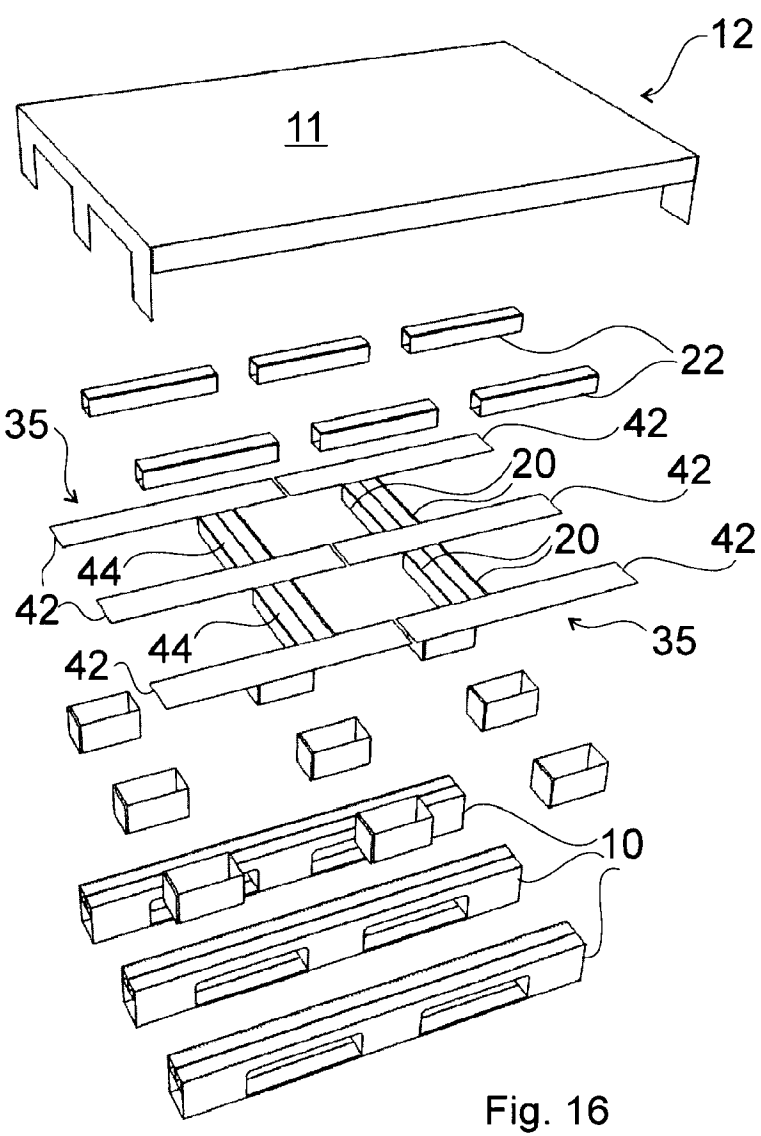
Figure 17:
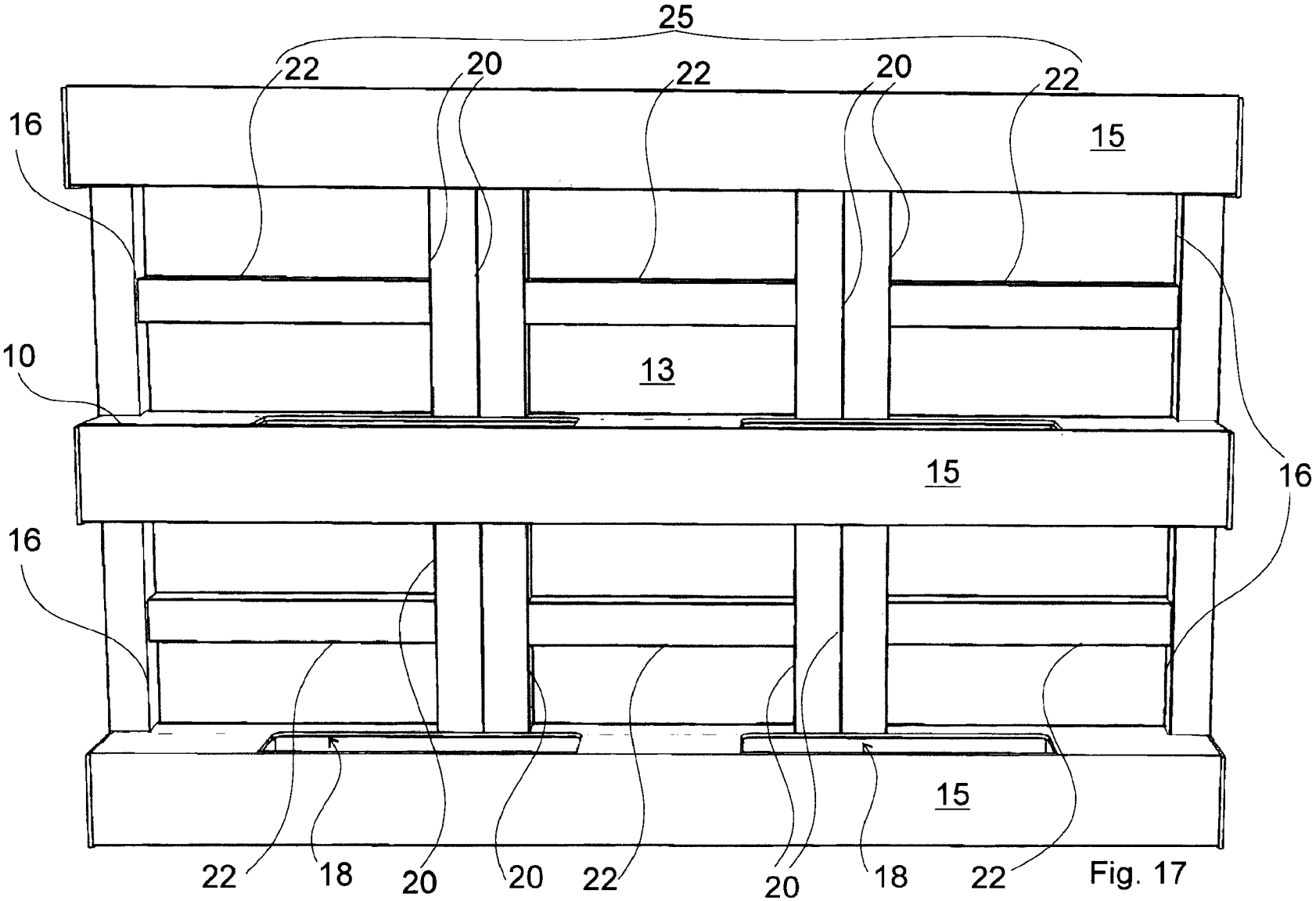
FIG. 17 shows an underside view of the embodiment of the pallet according to the invention shown in FIG. 1.

An exploded view of the pallet is shown in FIG. 16. In addition to showing other features shown also in FIGS. 13-15, this figure shows especially clearly that two intermediate elements 35 are arranged. In the assembled state the mutually facing ends of the attachment sheets 42 are preferably pushed together, a gap is shown between them in FIG. 16 only for better observation. FIG. 16 also illustrates that two such profile elements 20 are arranged in each group of the profile elements 20. In FIG. 16 a dividing line is shown between the profile elements 20; in reality the division between the profile elements 20 cannot be made out in this view but only the interconnection element 44 can be seen, which latter, however, is preferably formed of a single sheet and has no folding line. In this figure, therefore, the relative position of the interconnection elements 44 and the attachment sheets 42 is illustrated.

In FIG. 17—like in FIGS. 1 and 2—the embodiment of the pallet illustrated in the figures is shown in an assembled state. FIG. 17 clearly shows the system of profile elements 16, 20 and 22 in the assembled state. It is shown that the outer transverse stiffening profile elements 16 run parallel with the intermediate transverse stiffening profile elements 20, with longitudinal stiffening profile elements 22 of identical length being arranged in accordance with the distances. The longitudinal stiffening profile elements 22 are preferably supported against the profile elements 16 and 20 at the middle thereof. Central stiffening element 25, comprising the profile elements 20 and 22, is also indicated in the figure. According to the figure, the profile elements 20 and 22 are seated on the bottom surface of the cover element.

As shown in FIG. 17, the groups of the intermediate transverse stiffening profile elements 20 (arranged in pairs) are arranged such that they are located at the through openings 18 (i.e. that they are supported against the side walls of adjacent foot elements at the region that extends from the through openings towards the bottom surface, and more particularly at the through openings themselves). The integral, materially continuous configuration of the foot surfaces 15 can also be clearly seen. In FIG. 17 it is also illustrated that the foot elements 10 are closed off by covering sheets 26*a*, 26*b*, the figure showing the cross sections of these covering sheets 26*a*, 26*b*.

Figure 18:
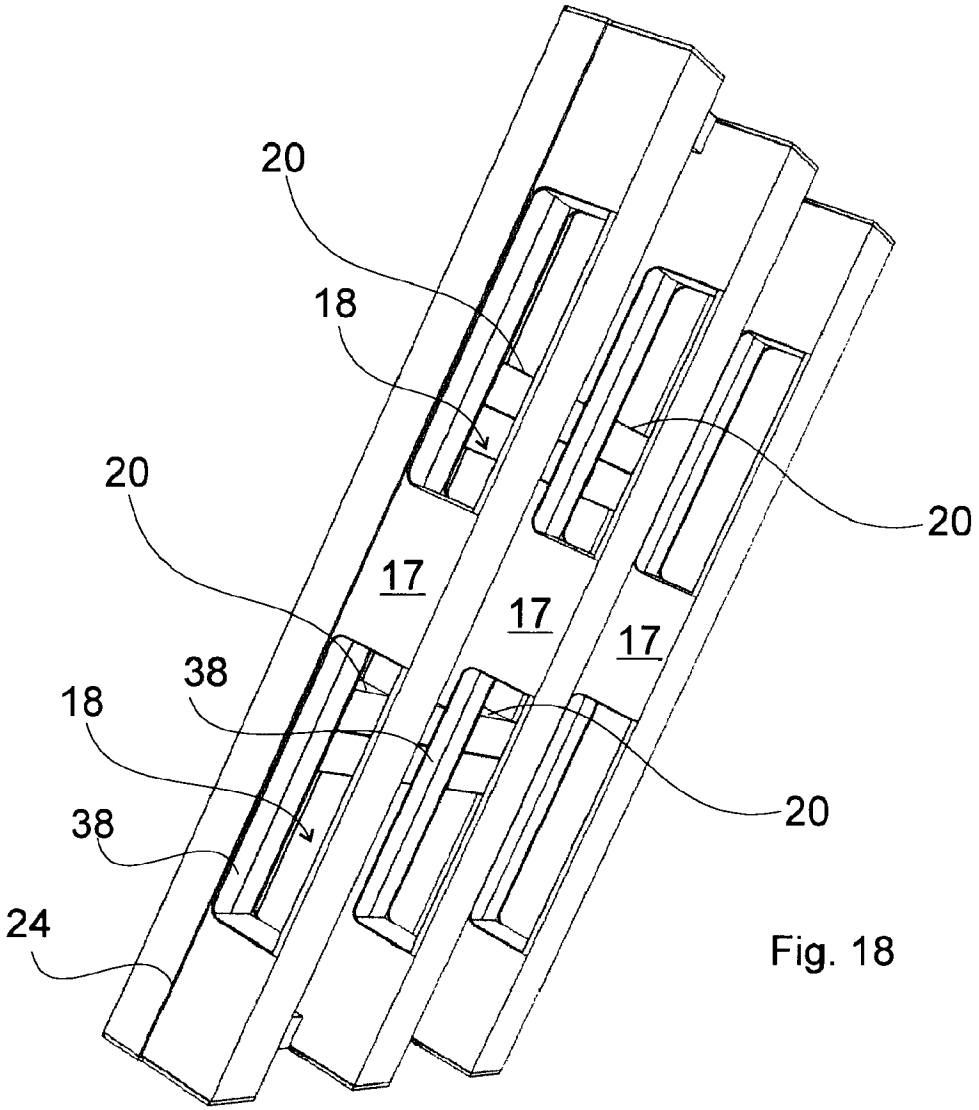
FIG. 18 is a drawing showing yet another view of the embodiment of the pallet according to the invention shown in FIG. 1.

In FIG. 18 the embodiment of the pallet according to the invention described above is illustrated in another view. This figure is included to illustrate particularly that in this embodiment the underside (the side facing the bottom of the pallet) of the intermediate transverse stiffening profile elements 20 and the foot profile elements 38 lies in the same plane. The plane of the outer transverse stiffening profile element 16 facing in this direction, as well as the plane of the optionally arranged longitudinal stiffening profile elements 22 facing towards the bottom of the pallet preferably also fall into this plane (as shown in FIG. 17, in this embodiment these latter conditions hold true). In an embodiment, therefore, the height of the longitudinal stiffening profile elements 22 measured from the bottom surface 13 is identical to the height of the outer transverse stiffening profile elements 16 and the intermediate transverse stiffening profile elements 20 measured from the bottom surface 13.

This arrangement allows for (preferably automated) strapping from both the longitudinal and the shorter directions of the pallet. In the case of strapping the straps extend from the longitudinal side preferably along the side of the intermediate transverse stiffening profile elements 20 facing the bottom of the pallet, and from the shorter side along the side of the longitudinal stiffening profile elements 22 facing the bottom of the pallet. Strapping with a single strap per direction, or dual straps per direction (through both through openings 18 along the longer side) can of course also be applied if so required. The wide bottom surface formed by the pairs of intermediate transverse stiffening profile elements 20 allows for even laying more than one straps beside each other.

Figure 19:
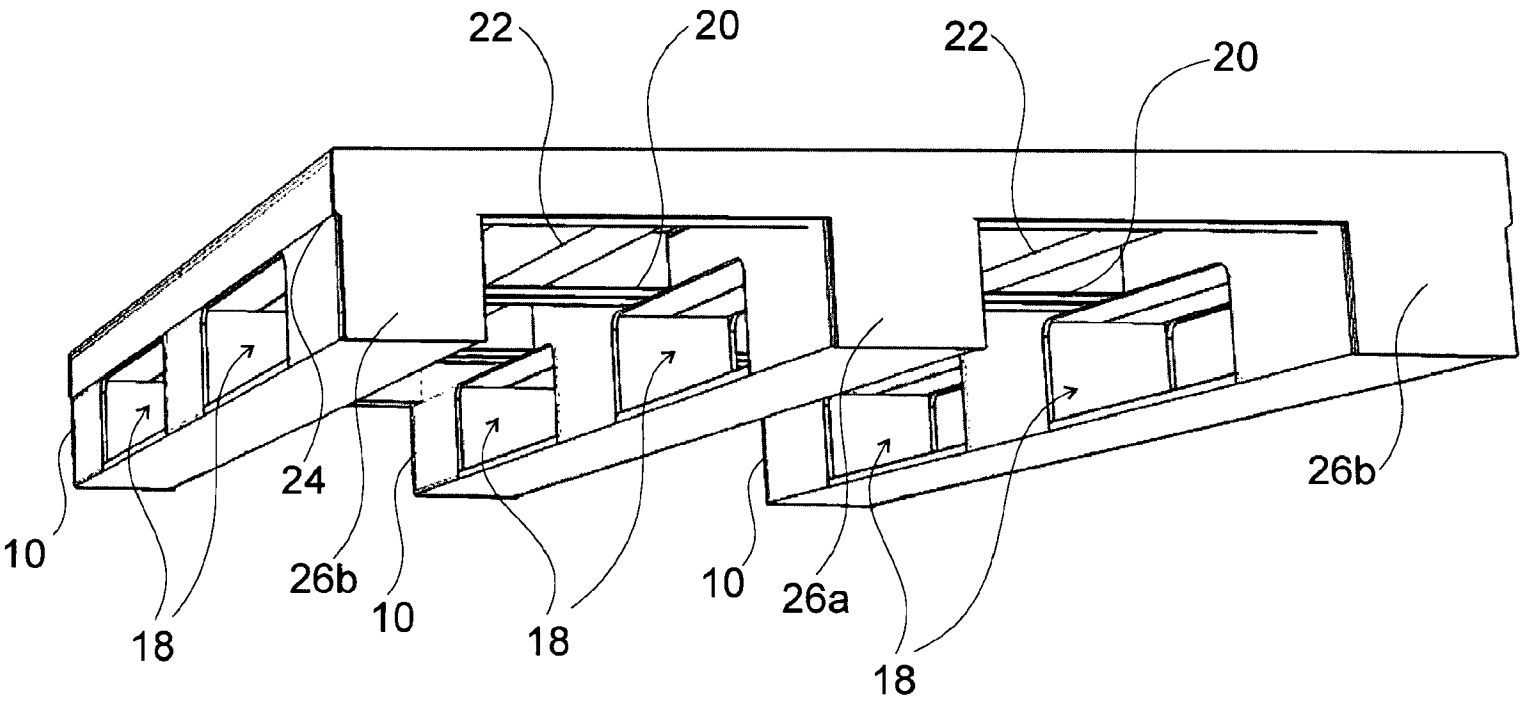
FIG. 19 shows a view of the embodiment of the pallet according to the invention shown in FIG. 1.

A still further view is illustrated in FIG. 19. In this figure the present embodiment of the pallet is shown slightly from below. As shown also in this figure, the profile elements 38 of the foot elements 10, the intermediate transverse stiffening profile elements 20, the outer transverse stiffening profile elements 16, and the underside of the longitudinal stiffening profile elements 22 are arranged in a common plane. In addition to that, in FIG. 19 it is shown that the foot elements 10 are thickened at the through openings 18 by means of stiffening sheets 34, and also that support elements 14 are arranged in the pallet. In this view, therefore, there are arranged the support elements 14, so the view between the through openings 18 is obstructed. Covering sheets 26*a*, 26*b* arranged at the ends of the foot elements 10 are also shown in the figure.

Figure 20:
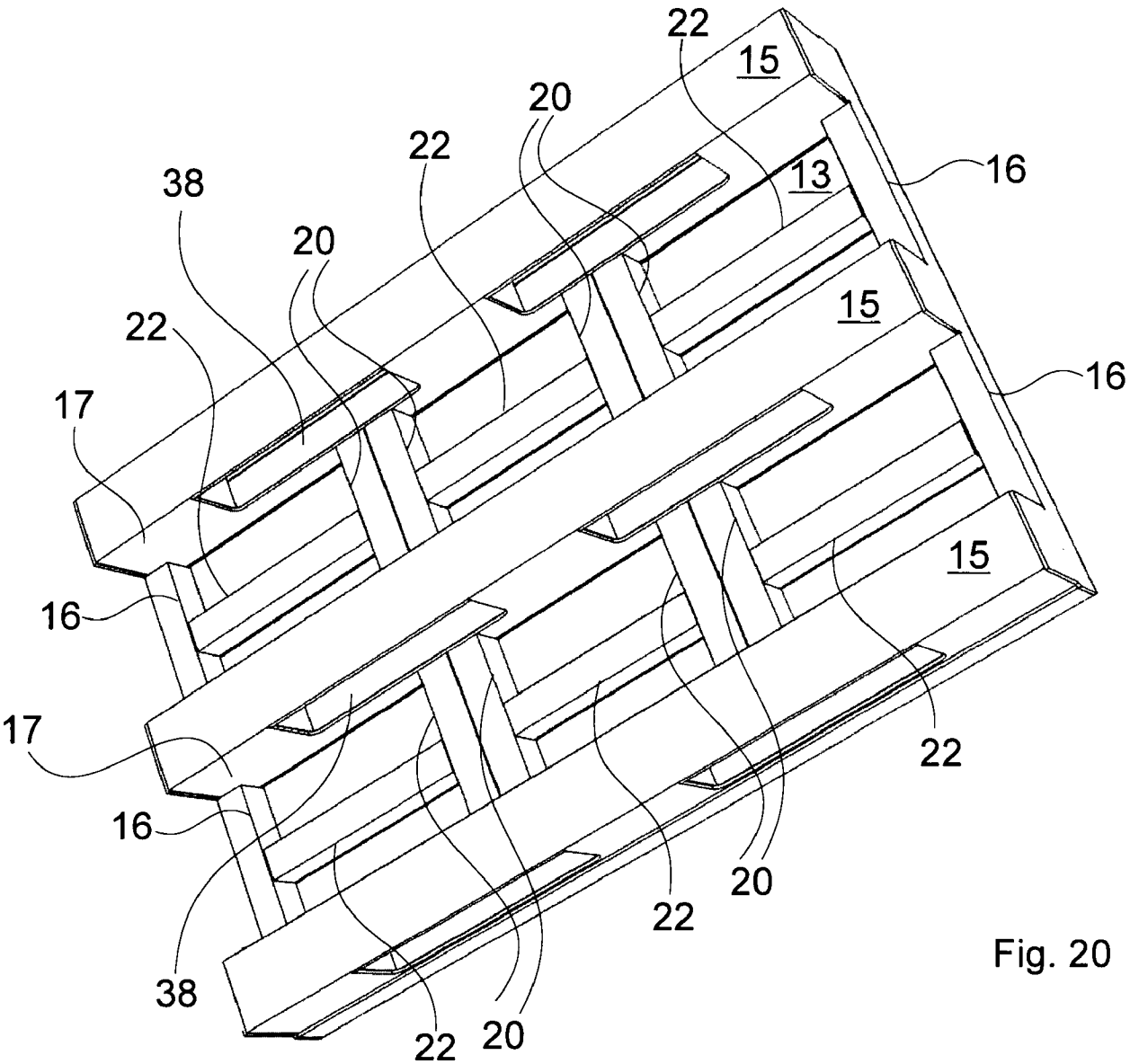
FIG. 20 is a further underside view of the embodiment of FIG. 1.
Figure 21:
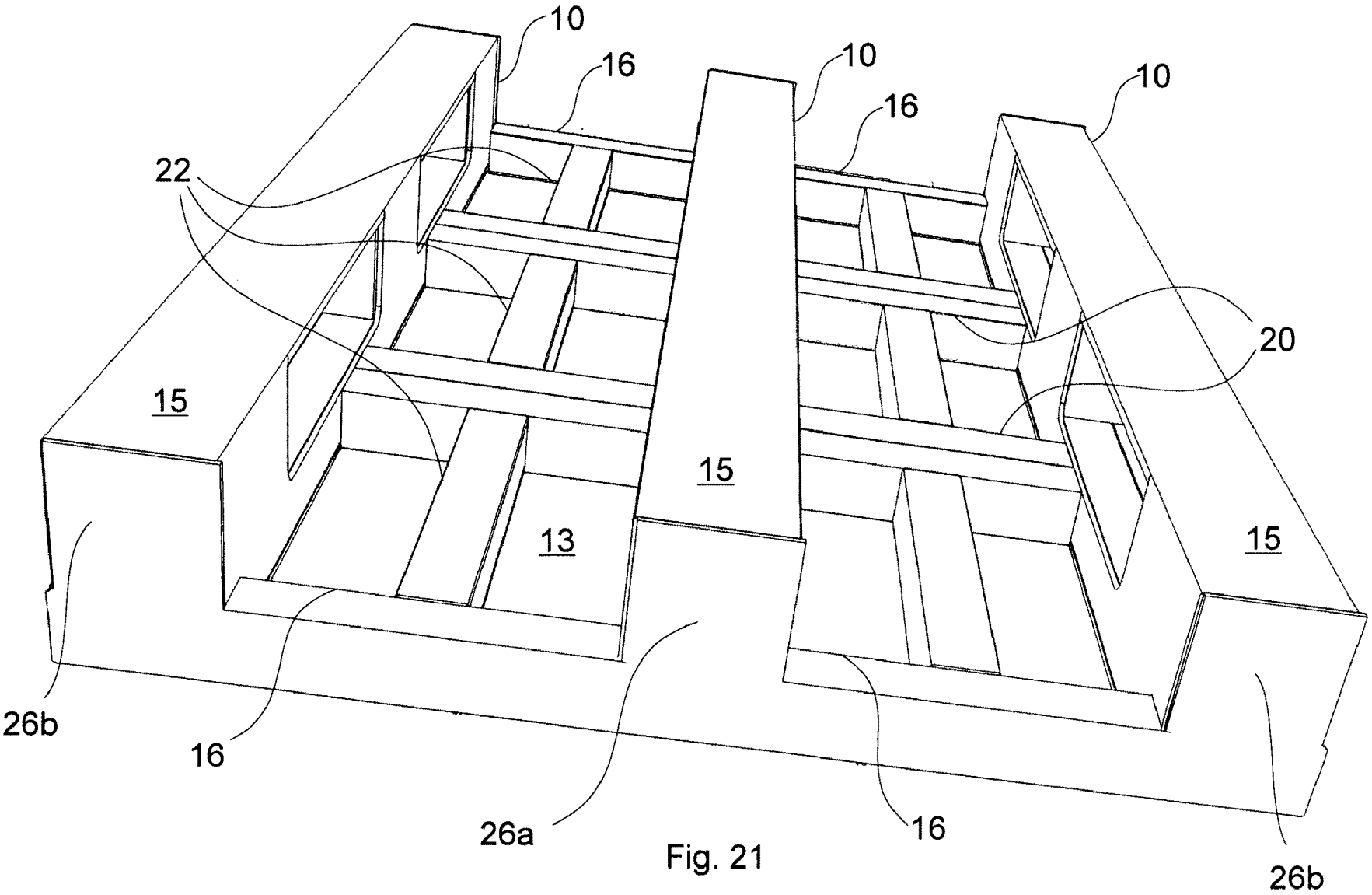
FIG. 21 shows another view of the embodiment of FIG. 1.

An underside view of the illustrated embodiment of the pallet is shown also in FIG. 20. It is particularly well illustrated by this view that in this embodiment the profile elements 16, 20 and 22 have a rectangle based block shape. The manner in which the profile elements 16, 20, and the longitudinal stiffening profile elements 22 are supported against the side walls 17 and the profile elements 16, 20, respectively, can also be clearly observed in the figure. As shown also in this figure, the sides of the profile elements 16, 20, 22, and 38 facing the bottom of the pallet are arranged in a common plane.

For forming the common plane, it is preferred to take into account the layer thickness of the foldable sheet material (e.g. corrugated paper). For example, in the assembled state the attachment sheet 42 is arranged between the foot element 10 and the bottom surface 13. The foot element 10 is connected to the bottom surface 13 via the profile element 38, i.e. according to the arrangement of the attachment sheet 42 there is an additional layer between the profile element 38 and the bottom surface 13. In the present embodiment such an additional layer is arranged between the profile element 20 and the bottom surface 13, as the profile element 20 is folded onto the interconnection element 44. In case of the outer transverse stiffening profile element 16 this additional layer is produced by "folding" the profile element 16 onto the bottom surface 13, which results in two layers being located at the side of the profile element 16 facing the bottom surface 13. A similar double layer can be obtained by placing (preferably, adhesively bonding) the longitudinal stiffening profile element 22 onto the bottom surface 13 with the side at which the side of the profile element 22 has a double-layer configuration (see FIG. 10). Of course, to secure the advantages of the above described features it is required that the height of the above subassemblies is specified in a coordinated manner.

FIG. 20 further illustrates that the pairs of the profile elements 20 are connected to the side walls 17 at approximately the inside one-third of the length of the through openings 18. The above mentioned features, such as the common plane, particularly the common plane formed with the longitudinal stiffening profile elements 22, can be clearly seen in FIG. 21, where in the illustrated embodiment the pallet can be seen in underside view.

The pallet according to the invention preferably has the following technical features:

(a) mass: less than 4.5 kg;

(b) maximum applicable distributed load: 5000 kg;

(c) maximum applicable distributed bending load: not lower than 1500 kg (the load capacity of pallets made of corrugated paper sheet is typically around 400 kg);

(d) in certain embodiments automated strapping can be applied thanks to the identical strapping planes (allowed by the identical height from the bottom of the pallet of the transverse stiffening profile elements 20 and the foot profile elements 38, by the identical height from the bottom of the pallet of the outer transverse stiffening profile elements 16, the transverse stiffening profile elements 20 and the longitudinal stiffening profile elements 22, or by the low height difference between the foot profile elements 71 and the central stiffening element);

(e) with surface treatment the pallet can be preferably made watertight and mist-free (protection against water can be provided), and thus reusabilty can be achieved.

The construction of the pallet according to the invention preferably made of corrugated paper sheet is as follows: The pallet according to the invention is therefore composed of three (and optionally, two additional) types of components. (i) foot element (leg), (ii) central stiffening element (e.g. outer transverse stiffening profile element and intermediate transverse stiffening profile element or a central stiffening element of other type), (iii) cover element (cover), and in certain embodiments, optionally (iv) longitudinal stiffening profile elements and (v) support elements (studs) that can be arranged in the foot element.

According to the invention, the major part of the components is preferably designed along the same principle (made from foldable sheet material), so they can be manufactured utilizing a uniform manufacturing technology (performing folding and adhesive bonding steps). In sum, the product is well suited for series production.

The stock material of the components is preferably flat-cut (i.e. cut out from flat sheet stock) corrugated paper sheet.

In the pallet according to the invention open and/or closed profiles are formed by folding and adhesive bonding from the flat-cut corrugated sheet (in certain cases the profiles are covered by the side wall of another component or by another component custom-made for this purpose by flat-cutting from another folding preform).

According to the invention, the pallet is preferably assembled from its components by adhesive bonding. At most of the interconnections, especially where sheets belonging to certain components made from foldable sheet material are seated on each other, adhesive bonding can preferably be applied (i.e. adhesive bonding has only advantages and no drawbacks). Adhesive bonding can preferably be applied for such interconnections where adhesive bonding cannot be applied between surfaces but only for securing edges to surfaces. For example, the ends of the longitudinal stiffening profile elements (profile elements with only walls but no end plates) can be expediently adhesively bonded to the side wall of the foot elements, and/or the ends of the longitudinal stiffening profile elements to the transverse stiffening profile elements, while adhesive bonding can also be applied in the case of the portions (edges) seated on the cover element of the various block-type central stiffening elements (e.g. honeycomb-structure or comb grid type ones).

Another advantage of the pallet design according to the invention is that in case corrugated paper sheet is applied as foldable sheet material the orientation of the undulations of the corrugated sheet can be chosen appropriately. Making use of this it is expedient to seek to minimise the number of free edges, which helps produce a pallet configuration that is optimal from the aspect of loading capacity. The upright undulations (standing waves) located inside the corrugated paper sheets play a great role in bearing loads, while open edges are significant for surface treatment (open edges are to be avoided if possible).

Another advantage of the configuration is that the profile elements (closed profiles) arranged preferably in the foot element (leg), at the edge of the cover element (outer transverse stiffening profile element, preferably formed integrally with the cover element), as intermediate transverse stiffeners (intermediate transverse stiffening profile element) and, optionally, as longitudinal stiffeners (longitudinal stiffening profile element) are preferably brought together to form a rigid closed frame (frame structure) after the pallet is assembled; a similarly strong structure can be obtained also by utilizing central stiffening elements of a different type.

In the embodiment illustrated in FIGS. 1-21 this results from the fact that the constituent parts of the frame structure, i.e. (i) the profiles of the upper square-based block located inside the longitudinal-direction legs (foot profile elements; their outside projected dimensions), (ii) the square-based blocks of the stiffening elements (intermediate transverse stiffening profile elements) extending perpendicularly to them, and (iii) the outside closing profiles of the cover (outer transverse stiffening profile elements) extend in the same plane (i.e. at the same height relative to the cover element), and produce a closed system bounded uniformly by right angles such that each element of the closed system is in direct contact with another element to transfer loads.

A general design principle of the invention is that it is possible to increase the loading capacity of all profile elements (closed profiles) by increasing the thickness of the material by further winding the bending core (i.e. by making multiple windings to produce the profile elements) This results in improved static loading capacity and increased bending strength of the pallet. Loading capacity can also be increased by increasing the thickness of the applied foldable sheet material (preferably, corrugated paper sheet).

In the embodiment according to FIGS. 1 and 22 the loading capacity of the pallet according to the invention can optionally be further increased by arranging additional outer and intermediate transverse and longitudinal stiffening profile elements (transverse and longitudinal stiffeners), and the other central stiffening elements can also be further reinforced (e.g. by applying a denser structure or increasing the number of ribs).

The embodiment of the pallet according to the invention shown in FIG. 1 has for example the following dimensions (of course any other dimensions can also be applied). The dimensions of the pallet according to the example are given for the subcomponents of the second folding preform 30 shown in FIG. 3; the second folding preform 30 can of course be prepared with other dimensions.

In the example, the length and the width of the second folding preform 30 is 1187 mm and 720 mm, respectively. The length value (the length of the foot element 10) essentially determines the length of the pallet itself, the width of the pallet being proportionally smaller than that. The width of the first and second sheets 31, 32, is 98 mm and 138 mm, respectively. The length of the stiffening sheet 34 is 334 mm (accordingly, in the assembled state the through opening 18 has the same length; the height of the through opening is 88.5 mm). The width of the stiffening sheet 34 is 48.5 mm, i.e. the combined width of two sheets folded back beside each other is 97 mm. Taking into account the tolerances also resulting from folding they can be folded such that they are supported against each other along their longer edge on the first sheet 31 to a good approximation, and thereby, to a good approximation, cover the width thereof. To facilitate the folding operation, the stiffening sheet 34 is connected to the first sheet 31 along its longer edge via an interconnection element having a width of 7 mm.

Due to the length dimension of the through opening 18 the distance between the through openings 18, as well as the distance between the through openings 18 and the edge of the foot element 10, is 173 mm (this dimension defines one of the side dimensions of the support element 14; the other side dimension thereof corresponds to the width of the sheet 31, while its height corresponds to the 88.5-mm height of the through opening 18).

The length of the first openings 33 is the same as the length of the stiffening sheet 34, while their largest width is 40 mm. The corners of the first openings 33 lying distal from the stiffening sheets 34 are rounded off with a radius of 15 mm.

From inside to outside, the width of the first mantle elements 36 is, 48 mm, 43 mm, 43.5 mm, and 38.5 mm, i.e. the thickness of the material is preferably taken into account when dimensioning the mantle elements in order that a square based block shaped foot profile element 38 can be made utilizing the mantle elements 36.

As illustrated in the figures, most components of the pallet according to the invention can preferably be made from foldable sheet material, for example corrugated paper sheet. When applying corrugated paper or corrugated sheet, the thickness of the material can be e.g. 5 mm or 7.5 mm (it can also be smaller or larger than that).

In the pallet according to the invention the surfaces abutted against each other are typically adhesively bonded together. Adhesive bonding is applied also for inserting the stiffeners, i.e. the first and the longitudinal stiffening profile elements. The profile elements preferably produce a frame (grid) structure; adhesive can also be applied to the ends of the profile elements, and thus they can be bonded to the side wall of the foot element, or to another profile element.

As illustrated in the figures, the pallet according to the invention preferably comprises a full-surface cover element (i.e. one with a surface without any interruptions by slots or openings). The load bearing surface of the cover element 11 that is expediently formed integrally, therefore, preferably shares these features. Accordingly, cargo can be particularly easily loaded onto the load bearing surface 11. The cargo may for example be a single box, even integrated onto the load bearing surface, but it may also be several smaller objects.

The pallet according to the invention can be manufactured very simply, because several of its components can be obtained by folding an appropriately cut-out preform, or preferably by adhesive bonding.

In FIG. 22 an embodiment is illustrated that is similar to the embodiments described above. The differences between this embodiment and the similar embodiment described above are discussed below. At the bottom of the exploded drawing of FIG. 22 foot elements 60 having through openings 67 and side walls 69 are shown, and the ends thereof is configured differently from the ends of the foot elements 10. At the top of FIG. 22 a cover element 62 is shown; the foot elements 60 are described in relation to that. At the extremities of the cover element 62, in the regions where the foot elements 60 to be arranged later would be received, there are arranged receptive foot ends 76, for the three foot elements 60 shown in FIG. 22, a total of six foot ends 76 are comprised (they are essentially covers, cover elements for support elements 64 that are arranged at the ends of the foot elements projecting therefrom).

In the embodiment of FIG. 22 foot profile elements 71 extending along the upper portion of the foot element 60 are shorter in the longitudinal direction than the foot element 60 itself (and, than the cover element 62). In FIG. 22 it is shown that support elements 64 (studs) extend beyond the foot profile elements 71. The support elements 64 are fitted into the foot ends 76 of the cover element 62, while the foot profile elements 71 extend just as far as the foot ends 76. Because of that, in this embodiment outer transverse stiffening profile elements 68 being perpendicular to the longitudinal direction of the foot elements 60 are arranged on the bottom surface of the cover element 62 at the edges of the cover element 62. In this embodiment, furthermore, one outer transverse stiffening profile element 68 being perpendicular to the longitudinal direction of the foot elements is arranged at each edge, the central stiffening element 65 is supported also against the outer transverse stiffening profile elements 68, and the corresponding ends of each foot element 60 is supported on the respective outer transverse stiffening profile element 68 (i.e., as illustrated in the figures, in an embodiment the ends of the foot elements and also the central stiffening element are supported on the outer transverse stiffening profile elements). The outer transverse stiffening profile element 68 preferably extends along the full width of the cover element 62 (as the outer legs are arranged along the longitudinal edges of the cover element 62), and so it can also be called a full-width outer transverse stiffening profile element 68.

As indicated by the figures, the above description related to the outer transverse stiffening profile elements also applies to the embodiments illustrated in the figures to be described below.

Furthermore, in the embodiments according to FIGS. 22-28C, on its side facing the bottom surface the foot element 60 comprises a foot profile element 71 being made from foldable sheet material and having the same height relative to the bottom surface as the outer transverse stiffening profile element 68, and the end of the foot profile element 71 is supported on the outer transverse stiffening profile element 68, and, projecting out from the foot elements 60 at their respective ends, support elements 64 are arranged bordered by the foot profile element 71, the side walls 69, and a region belonging to the foot surface, and a projection length of the support elements 64 from the foot element 60 is equal to the width of the outer transverse stiffening profile element 68 measured in the longitudinal direction of the foot element 60, and the outer transverse stiffening profile element 68 are arranged as being supported on support elements 64 projecting out from the foot elements 60 in the corresponding direction. Thus, in this embodiment—as shown in the figures, and just like in the embodiment shown in FIGS. 1-21—the foot element 60 comprises foot profile elements 71 that are supported on the outer transverse stiffening profile elements 68 at the ends of the foot element 60, and the projection of the support elements 64 from the foot element 60 is set such that it can provide support to the profile element 68, i.e the profile element 68 can fit exactly inside the corner encompassed by the ends of the foot profile elements 71 and the support element 64. As shown in the figures, the profile element 68 is supported on the support elements 64, i.e. it is seated thereon.

In the embodiment of FIG. 22 a structure made up of transverse stiffening profile elements 70 and longitudinal stiffening profile elements 72 is arranged as a stiffening element 65. As illustrated in FIG. 22, the longitudinal stiffening profile elements 72 are arranged along the longitudinal direction of the pallet, and the transverse stiffening profile element 70 are arranged between them in pairs, extending transversely to them. In the stiffening element 65 comprising three longitudinal stiffening profile elements 72 and four transverse stiffening profile elements 70 the profile elements can also be adhesively bonded together. As there are three foot elements 60, two stiffening elements 65 are arranged. The components of the stiffening element 65 are dimensioned such that when the outer transverse stiffening profile elements 68 is in place, at the ends of the covering sheet 62 of the pallet, the stiffening element 65 is just supported on the outer transverse stiffening profile elements 68 via the ends of the two outer longitudinal stiffening profile elements 72.

Accordingly, in this embodiment the central stiffening element 65 comprises longitudinal stiffening profile elements 72 being made from foldable sheet material, being arranged between the outer transverse stiffening profile elements 68 and the intermediate transverse stiffening profile elements 70 adjacent thereto and/or between respective intermediate transverse stiffening profile elements 70 arranged at the through openings 67, and being supported by their ends against the respective transverse stiffening profile elements 68, 70. As with the central stiffening element 25 of the embodiment of FIGS. 1-21, in the embodiment of FIG. 22 there are also arranged appropriate longitudinal stiffening profile elements designated by the reference numeral 72.

In this embodiment there is also arranged (for both central stiffening elements 65) between the mutually facing side walls of the adjacent foot elements 60 a cover sheet 66 adapted to cover the central stiffening element 65 from the side opposite the bottom surface. The cover sheets 66 are preferably dimensioned such that they can be fitted exactly between the two foot elements 60 (i.e. they have a width corresponding to the distance between the foot elements 60), while in the other direction their dimensions are such that they extend as far as both extremities of the cover element 62, i.e. that they cover the central stiffening elements 65 and also the outer transverse stiffening profile elements 68 (they might cover only the central stiffening elements 65, but with the former arrangement they can form a uniform surface between the foot elements 60 at the bottom of the pallet). The cover sheet applied in various embodiments is preferably secured to the components in contact therewith (the outer profile element 68 or stiffening element) across the entire contact surface.

Figure 23A:
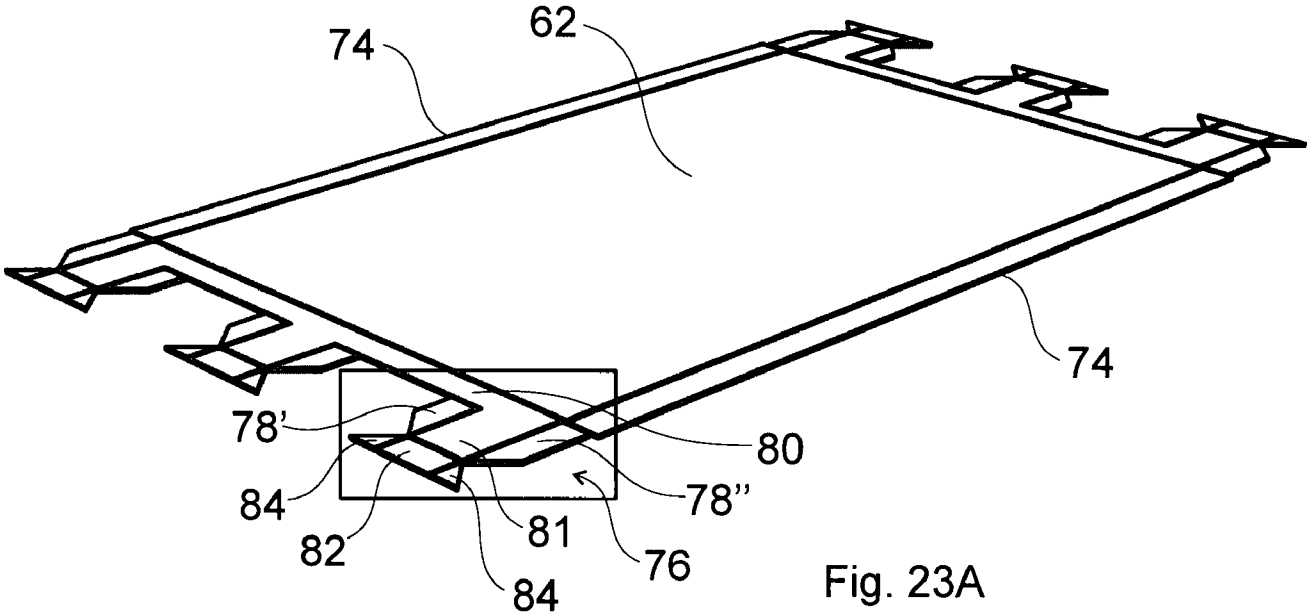
FIG. 23A is a drawing illustrating a folding preform for the cover element applied in the embodiment of FIG. 22.
Figure 23B:
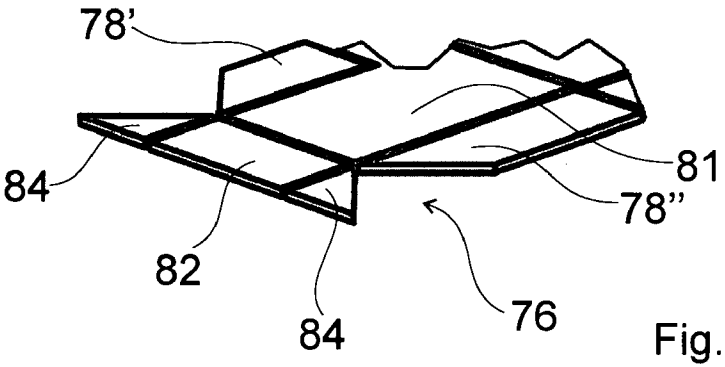
FIG. 23B is a detail drawing of the preform of FIG. 23A.

In the embodiment of FIG. 22, furthermore, the foot ends 76 are configured to be integral with the cover element 62. A folding preform corresponding to the foot ends 76 is shown in FIG. 23A, with FIG. 23B showing a magnified view of a preform corresponding to a single foot end 76. In its middle region, the preform shown in FIG. 23A comprises a continuous flat portion adapted for making the cover element 62. All other portions of the preform that are to be folded further lay flat, the figure also showing the folding edges. Along the longitudinal sides of the cover element 62 downward-extending side covering sheets 74 are shown.

A respective downward-extending outer sheet 80 is connected to each of the two shorter ends of the cover element 62. Three central covering sheets 81 are connected to each of these sheets 80 (in accordance with the number of the foot elements 60) such that after folding down the sheets 80 the central covering sheets 81 remain in the same plane as the sheets 80. Two first auxiliary sheets 78', 78" are connected from both sides to the central covering sheet 81, (the configuration of the first auxiliary sheets is slightly different for the central foot ends 76, in which case they are symmetrical, while for the outer covering sheets 81 they have asymmetrical configuration), with a rectangular second auxiliary sheet 82 being connected to its end lying opposite the cover element 62, and with a respective triangular third auxiliary sheet 84 being connected to two of the sides of the second auxiliary sheet 82.

The outer covering sheet 80 is folded down such that it lies at a right angle with respect to the cover element 62. Then, the auxiliary sheets 78', 78" are also folded at a right angle with respect to the central covering sheet 81. When folded at a right angle, the auxiliary sheet 82 becomes parallel with the cover element 62. By folding inwards the auxiliary sheets 84, an extension of the auxiliary sheets 78', 78" is obtained (the triangles fit into the cut-down portion, adhesive bonding is expediently applied at the contact edge), and the receptive foot end 76, which receive a respective support element 64, is thus produced. The foot surface of the foot element 60 is therefore not materially continuous because a separate foot end being pulled on the support element 64 located at the end of the foot element 60. However, that way the edges are better protected. According to the above, the foot end 76 is preferably folded from a material having the thickness of a single layer, in that case it forms a natural continuation of the foot element 60, since in that case the single-layer thick component is pulled on the support element 64 that is encompassed by the material of the foot element 60 which is also as thick as a single layer. That way the end of the foot element 60 can also be made in a suitable manner, and the outer transverse stiffening profile elements 68 are also arranged in a favourable manner because the foot element 60 is terminated at such a distance before the covering sheet 80 which allows that the outer transverse stiffening profile element 68 can be inserted in the resulting gap (supported by the support elements 64).

In this embodiment, therefore covering sheets 81 are connected to the cover element 62 at the ends of each foot elements 60, with auxiliary sheets 78', 78", 82, 84 being connected to the covering sheets 81, the portion of the support element 64 projecting out from the foot element 60 is covered, except for the portion being in supporting connection with the outer transverse stiffening profile element 68 (i.e. contacting the profile element 68), by the covering sheet 81 and the complementary sheets 78', 78", 82, 84 being folded over the portion of the respective support elements 64 projecting out from the foot element 60 (i.e. when the components of the pallet are assembled, the auxiliary sheets extend as far as the ends of the foot element 60, with their extremities running along the edges thereof). It is therefore a requirement that the covering sheet and the auxiliary sheets have to fulfil that they should cover the free surfaces of the support element projecting out from the foot element; accordingly, e.g. the auxiliary sheets may be configured differently than in the figure (e.g. the auxiliary sheets 78', 78" can have a straight end and they can extend as far downwards as the bottom of the covering sheet 81, in which case the auxiliary sheets 84 would not be necessary), however, the illustrated configuration provides very good edge protection.

Thus, the foot elements 60 are configured in the same way as in the embodiment illustrated in FIGS. 1-21, except that they are approximately 50 mm shorter at each side. Also, the stud (the support element 64) projects by approximately 50 mm, and it is covered by the foot end 76. Thus, the length corresponding to the foot elements 10 shown in FIGS. 1-21 is obtained by adding up the lengths of the projecting studs and the transversely arranged outer transverse stiffening profile element 68. With this change the open edges become hidden, and protection against humidity has become simpler. Furthermore, in the embodiment according to FIG. 1 the downward-extending tab was subjected to dynamic load in the event of dropping the pallet, which could cause crumpling in the upper zone (when the tab is secured at more than one locations and folds back crumpling can be more easily prevented). As this phenomenon does not occur with lower loads, the application of the approach of FIG. 1 is also advantageous.

In the embodiment of FIG. 22, at the contact locations of components, e.g. the part of the stiffening element 65 seated on the bottom portion of the cover element 62 (bottom surface), the ends of the longitudinal stiffening profile elements 72 in contact with the outer transverse stiffening profile element 68 are adhesively bonded to the components in contact therewith, and also the outer transverse stiffening profile element 68 is preferably secured in place by adhesive bonding.

In the embodiments of FIG. 22 and further figures it holds true that the height of the central stiffening element measured from the bottom surface is at least 90% of the distance measured between the through openings and the bottom surface. In these embodiments comprising a cover sheet 66 the height relations are the following. In these embodiments an outer transverse stiffening profile element 68 is arranged and in the foot elements 60 foot profile elements 71 are arranged (these latter are supported against each other in the longitudinal direction). The profile elements 68 and 71 have the same height, both of them being arranged directly under the cover element 62 and being preferably connected (attached) thereto by adhesive bonding. The stiffening elements utilized in some embodiments (more particularly, in the embodiment of FIG. 22, the stiffening element 65, or in the embodiment of FIG. 24A, the stiffening element 90) preferably also have the same height (i.e., the same height measured from the cover element 62).

The cover sheet 66 lies over the stiffening element (let us now consider the stiffening element 65) and on the outer transverse stiffening profile element 68 between the two foot elements 60, along its entire length under the cover element 62, i.e. extending longitudinally along the entire length of the pallet as far as the edge of the outer transverse stiffening profile element 68. If, therefore, the stiffening element comprises a cover sheet 66, then the height of the stiffening element measured from the underside of the cover element 62 (bottom surface) is defined by the outside face of the cover sheet 66 (when the pallet is placed on a support surface it is the bottom face thereof).

The distance of the through openings 67 from the bottom surface can be obtained as follows. As shown also in FIG. 22, in this embodiment the through opening 67 has a configuration "with corner", i.e. in contrast to the through opening 18 of the foot element 10 the corners of the through openings 67 of the foot element 60 facing the cover element 62 (situated on the side wall 69 of the foot element 60) are not rounded off. The configuration of the foot element 10 applied in the embodiment of FIGS. 1-21 is described in relation to FIGS. 3-5. As it was mentioned above in relation to these figures, when the foot element 10 is being formed, the stiffening sheets 34 are folded back into the through opening 18 (the stiffening sheets corresponding to the stiffening sheets 34 are also folded back in the embodiment of FIGS. 22-28C), however, excess sheet material is removed from the openings 33 formed in the side wall, i.e. an opening is formed in the second folding preform 30 (the material removed from the opening could also be folded back onto the side of the through opening 18 laying proximate the cover element 12, but in that case openings with rounded-off corners could not be formed).

In the embodiment of FIG. 22 the openings are produced in the side wall 69 by folding back the stiffening sheet playing the same role as the stiffening sheet 34 into the through opening 67, but in this case the other sheet to be folded back in order to form the opening is not removed but is also folded back into the through opening 67 (one sheet being folded to the upper side, the other to the lower side). Thereby, stiffening sheets are introduced also into the through opening 67 opposite the stiffening sheets corresponding to the stiffening sheet 34, these are folded onto the foot profile elements 71. The second stiffening sheet, folded back to this side of the through opening 67 will therefore define the distance between the through opening 67 and the bottom surface of the cover element 62. Since the central stiffening element (in this case, the stiffening element 65) and the profile elements 71 have the same height, the height difference results from the difference between the thickness of the cover sheet 66 and the thickness of the folded-back second stiffening sheet.

Figure 24B:
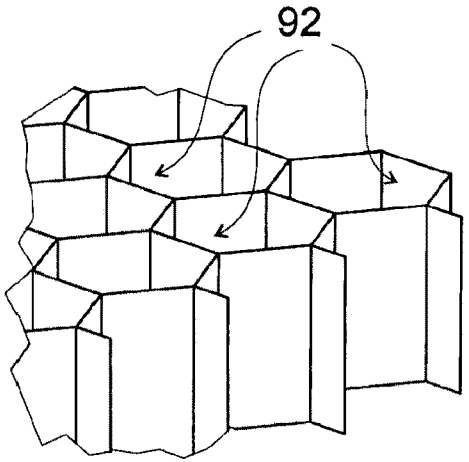
FIG. 24B is a detail drawing of the stiffening element of FIG. 24A.
Figure 24C:
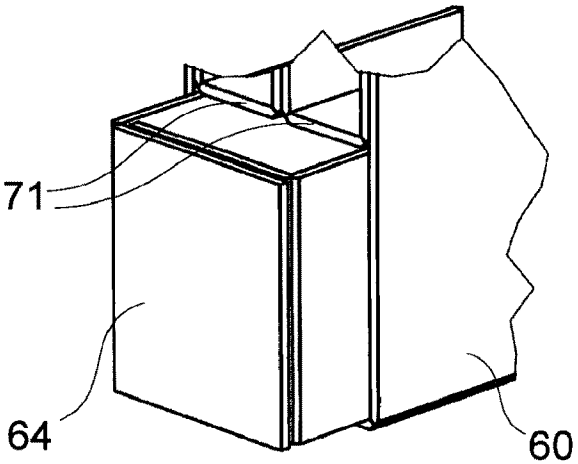
FIG. 24C is a detail drawing illustrating an end of the foot element of FIG. 24A.
Figure 24A:
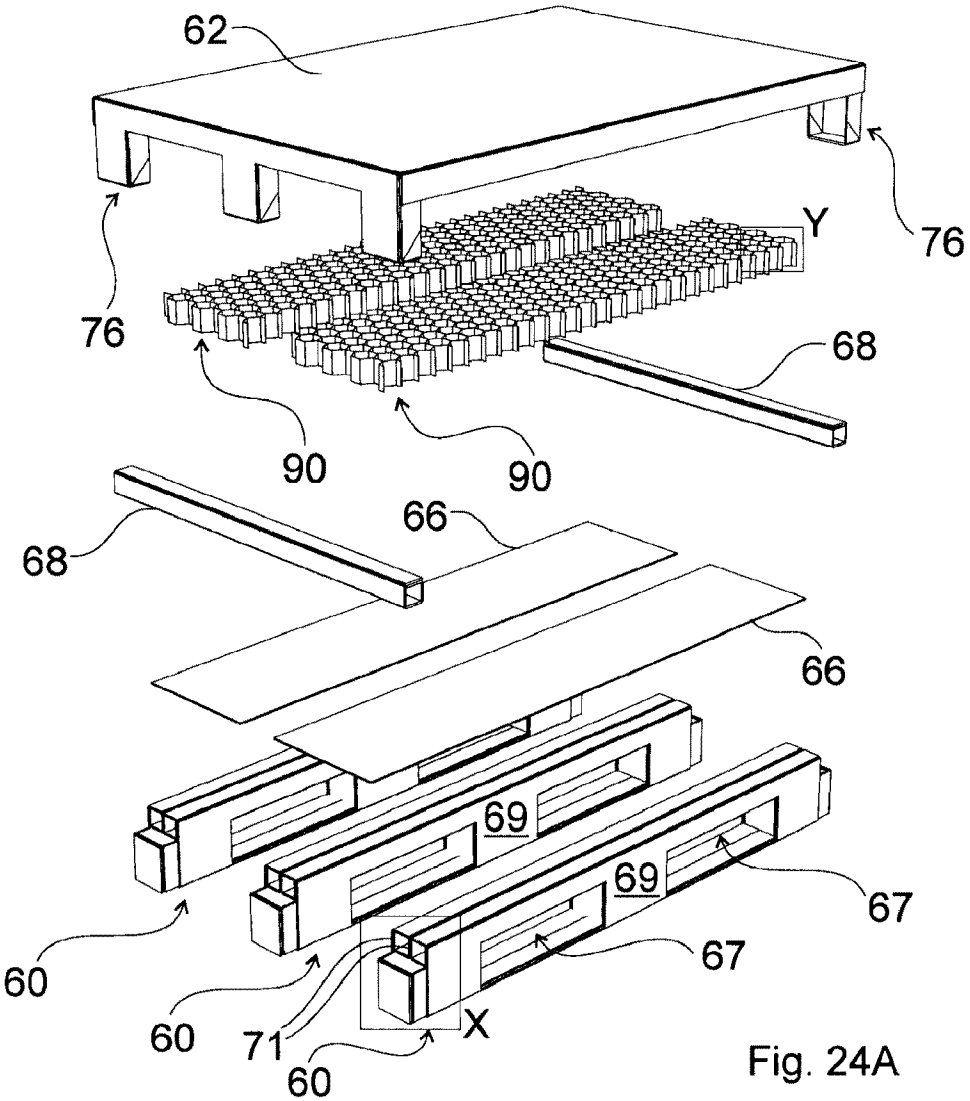
FIG. 24A is an exploded view of a yet further embodiment of the pallet according to the invention.

In an example based on the embodiment according to FIG. 24A, the thickness of the foot profile element 71 (the height measured from the bottom surface of the cover element 62) is approx. 40 mm, identical to the height of the stiffening element 90. Added up to that are the thickness of the cover sheet 66 (in the example, it is 2 mm) and the thickness of the folded-back second stiffening sheet (in the example, it is 4.2 mm), so the height difference is 2.2 mm, which is, to a good approximation, 5% of the height of the higher object (the foot profile element 71 and the second stiffening sheet, having a height of 44.2 mm), i.e. in this example the height of the central stiffening element, measured from the bottom surface, constitutes, to a good approximation, 95% of the distance between the through openings and the bottom surface. This difference is way under 10%; it can preferably also be specified that the height difference (first difference) should be under 6% or even under 5%. Considering the usual sheet thickness values (paper thickness values), the height difference is typically 0-4 mm, in particular 2-4 mm. The height difference may also have different reasons (different dimensioning), and may thus approach 20% (relative to the higher component).

The thickness of the second stiffening sheet is typically between 3-5 mm, preferably between 4-4.5 mm, so the height difference can be greater (or smaller) than that. The height difference may also be the result of the stiffening element having a smaller height than the profile element, or of the stiffening element being slightly compressed (for example, in the case of a honeycomb-structure) due to the adhesive bonding of its ends. It may also happen that the height of the central stiffening element is not uniform along the entire foot element, in which case the greatest height value (measured from the bottom surface of the cover element) is considered, i.e. the height measured at location where the stiffening element (or, as a part of it, the cover sheet) is furthest from the bottom surface.

From the above explanation of how the height difference is brought about it turns out that if—provided that other dimensions remain the same as before in this embodiment—the cover sheet and the second stiffening sheet were made of the same-thickness material, then no height difference would be brought about, so the distance of the through openings measured from the bottom surface would be the same as the height of the central stiffening element measured from the bottom surface, i.e. the outside surface of the cover sheet would be aligned (at the same level with) the outside surface of the second stiffening sheet. This may also be a substantially common level, if some—negligible—level difference occurs somewhere along the fitting.

This common level can also be formed when no cover sheet or second stiffening sheet is arranged (or the height difference is compensated in other way). The requirement for the present embodiment, namely that in a more preferred case the height of the central stiffening element, measured starting from the bottom surface is at least 80%, preferably 90%, of the distance measured between the through openings and the bottom surface, (i.e. it is smaller than 20%, preferably 10% of the greater one of the two) holds true also in this case. According to the above, this criterion is also fulfilled in the embodiment of FIGS. 1-21, because therein the foot profile element and the transverse stiffening profile element are arranged at the same height level.

The advantage of the above described arrangement of the second stiffening sheet compared to the through opening configuration applied in the embodiments according to FIGS. 1-21 is that by folding back the second stiffening sheet another open edge can be "hidden", i.e. covered at both sides of the foot element 60. This edge is the edge of the profile element 71 extending along the inner side of the side wall of the foot element 60 towards the through opening 67, which is thus covered by the folded second stiffening sheet.

In FIG. 24A a further preferred embodiment of the pallet according to the invention is shown, wherein the central stiffening element 90 is formed by a honeycomb-structure first block comprising cells 92 with their axes extending perpendicular to the bottom surface (see FIG. 24B). In the embodiments shown in FIG. 22 and in FIGS. 1-21 the stiffening element has an essentially modular configuration, formed by longitudinal and transverse stiffening profile elements (which are for example adhesively bonded together). In the embodiment of FIG. 24A, however, the central stiffening element 90 is formed (configured) from one piece to the rectangular shape being shown in the figure and fits into its appropriate prepared place in the pallet. When we refer to the honeycomb-structure stiffening element 90 as being formed from one piece we mean that it is cut to the appropriate height from a larger piece of honeycomb-structure block, with the dimensions of the honeycomb cells perpendicular to that being also cut from the larger honeycomb block to the appropriate size (the honeycomb-structure stiffening element 90 may also be manufactured to the appropriate size). At the same time, the walls of the—preferably hexagonal—honeycomb cells can also be made by adhesive bonding from multiple small wall portions, applying the usual manufacturing method of the honeycomb structure.

As shown also in FIG. 24B, the stiffening element 90 has a honeycomb structure comprising cells 92 arranged beside one another. For better load bearing capacity and load distribution, in the assembled state the open ends of the cells 92 face towards the bottom portion of the cover element 62 (the bottom surface) and in a direction opposite that. The open ends of the cells are thus supported on the bottom surface. Accordingly, in the assembled state the cell walls will be perpendicular to the bottom surface, i.e. the cells have an upright arrangement (provided that the pallet is arranged horizontally).

In the assembled state, the longitudinal sides of the stiffening element 90 blocks are supported against the side walls of the foot elements 60 which are facing to each other. This is to mean that the outer cells of the cut-to-size stiffening element 90 are cut according to the desired size (some cells can for example be cut to half along the longitudinal direction, see FIG. 24B), and the partial cell walls (cell wall parts) thus produced are seated against the side wall of the foot element 60. Some of the outer cells are cut also at the extremity of the stiffening element 90 extending perpendicular to the side wall of the foot element 60 (i.e. transversely). At this extremity, the stiffening element 90 is supported against the outer transverse stiffening profile elements 68. The support or contact surfaces of the stiffening element 90 are preferably adhesively bonded to the surfaces in contact with them. The honeycomb-structure stiffening element 90 is preferably adhesively bonded to the bottom surface of the cover element, followed by adhesively bonding thereto the cover sheet 66 adapted to cover the stiffening element 90. Apart from these adhesively bonded connections it is not necessary to join by adhesive bonding the sides of the stiffening element 90 to the outer transverse stiffening profile element and to the side wall of the foot elements 60 (doing so is not a problem, but yields not large extra effect). It is also true for the additional central stiffening elements that adhesively bonding them to the bottom surface and to the cover sheet is the primarily applicable.

The cover element 62 is provided with very good stiffening by the stiffening element 90 (it "stretches it out", providing that the cover element 62 to be stretched), provides transverse stiffening between the foot elements 60 while being supported against them, and also provides longitudinal stiffening while being supported against the outer transverse stiffening profile elements 68. The central stiffening element is adapted to fit between the cover element 62, the foot elements 60 and the outer transverse stiffening profile elements 68, so it contributes to preventing their mutual torsional or longitudinal displacement. It thus provides with support the cover element and also the other components. These advantages are to a greater or lesser extent also occur in those further embodiments that are shown in the subsequent figures; the extent to which they manifest themselves depends of the exact configuration of the stiffening elements. Cover sheets 66 adapted for covering (lining) the stiffening element 90 from below are arranged also in this embodiment, and in this embodiment, they also prevent moisture from entering the honeycomb cells. It is also preferable to apply them because they provide that the underside surface of the pallet is uniform also between the foot elements 60 and so the movement of the forklift forks utilized for lifting the pallet is not get caught by the honeycomb cells.

FIG. 24B shows a detail of FIG. 24A designated by the letter Y. It is apparent that in the illustrated case the height of the hexagonal cells of the honeycomb structure is somewhat greater than their width. A honeycomb structure with different proportions can of course also be applied in the stiffening element 90, for example more oblong cells, depending on the desired strength of the stiffening element. Denser honeycomb structures better withstand bending being perpendicular to the axis of the cells. The honeycomb-structure stiffening element 90 is made of paper (cardboard), and more generally, of foldable sheet material. For forming the honeycomb structure, a paper material that is typically thinner than corrugated cardboard—and has preferably a single layer—is typically applied, but a honeycomb structure made of corrugated cardboard can also be conceived.

The height of the honeycomb-structure stiffening element (i.e. its extension along the longitudinal direction of the cells) is preferably identical to the height of the foot profile element, that is, typically 40-50 mm, in an example 40 mm. The effective diameter (the diameter of the circle enclosing the hexagonal structure, or by a widely used term, grain size) of the honeycomb cells varies, for example it can be 8 mm, 16 mm, 20 mm or 40 mm. In an example the diameter is 16 mm, which provides a sufficiently dense grid for high load bearing capacity; in the figure such a grid would seem much denser compared to FIG. 24A or 24B (assuming the pallet has generic dimensions, the cells shown in these figures have an effective diameter of approximately 40 mm). Due to the applied manufacturing technology, in the honeycomb mesh the hexagonal cross-section of each cell is not a regular hexagon (unlike what is shown in FIG. 24B). According to a manufacturing technology, the hexagonal structure is prepared applying a strip-like sheet, i.e. long paper strips, with each strip being adhesively bonded, in an alternating fashion, to one of both adjacent strips (one such bond giving a side of a hexagon). Thus, in each hexagon there can be found two opposite—typically shorter—adhesively bonded sides, with the other two-two sides being joined together in an adhesively bonded connection. It may thus happen that the side walls of the cell are not flat but have a curvature, i.e. the sectional shape of the cell is a slightly distorted hexagon.

In FIG. 24C the end portion, that is, the portion designated by X in FIG. 24A, of the foot element 60 is shown. As can be observed in FIG. 24C, the foot profile elements 71 applied also in the foot element 60 (in the longitudinal direction, at the upper part thereof) are terminated (the side wall of the foot elements 60 being terminated at the same place), and the support element 64 projects from the foot element 60, i.e. from the chamber formed in the foot element 60 between the foot profile elements 71 and the bottom side of the foot element 60. As it is also illustrated in FIG. 24C, the support element 64 is preferably a closed profile element having a rectangular section that is arranged in an upright position (with its open end facing the foot profile elements 71).

Figure 25:
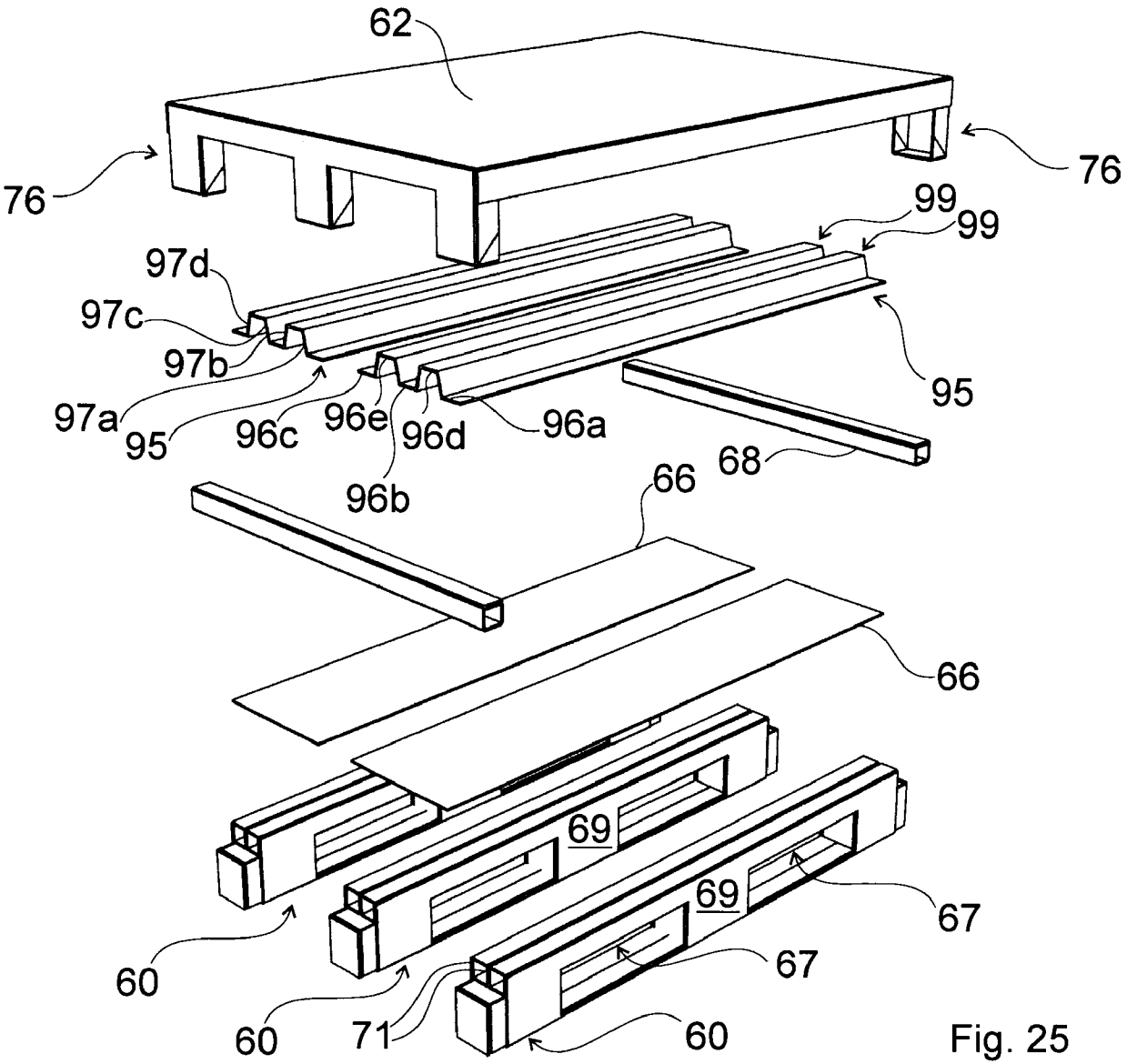
FIG. 25 is an exploded view illustrating an embodiment of the pallet according to the invention.

A further embodiment of the pallet according to the invention is illustrated in FIG. 25 also in an exploded drawing (similar to FIGS. 22 and 24A). In this embodiment a central stiffening element 95 is formed by a first open profile element comprising first ribs 99 extending parallel with the longitudinal direction of the foot elements 60. The stiffening element 95 configured in this manner rather provides longitudinal stiffening, its transverse stiffening is lower than what is provided by the honeycomb stiffening element 90 depicted in FIG. 24A. The undulations (ribs 99) are therefore formed in the stiffening element 95 in the longitudinal direction, parallel with the foot elements 60.

In the example according to FIG. 25 sheet elements 96*a*, 96*b* and 96*c* (lying parallel with the bottom surface in their inserted state) are arranged further from the bottom surface. Sheet elements 96*d* and 96*e*, also to be arranged parallel with the bottom surface (i.e. abutted thereon), lie closer to said bottom surface in the completed state. The longitudinal side (edge) of the outer sheet elements 96*a*, 96*c* are supported against the side walls of the foot elements 60 along the entire length of the stiffening element 95. The sheet elements 96*a*, 96*b* and 96*c* located at the bottom are connected with the sheet elements 96*d* and 96*e* located at the top by inclined sheet elements 97*a*, 97*b*, 97*c* and 97*d*, the sheet elements 96*a* and 96*d* being interconnected by the sheet element 97*a* and so on. This is how the undulated shape (waveform) is formed, the parts of which, i.e. the undulations form ribs that lie parallel with the foot elements 60 when the stiffening element 95 is in place.

The outer transverse stiffening profile elements 68 are arranged also in the embodiment of FIG. 25, with the open-profile ends of the stiffening elements 95, i.e. the undulated (ribbed) profile being supported against them. As with the embodiments illustrated in the preceding figures, the cover sheets 66 are also arranged. The stiffening elements 95 are preferably secured in place by adhesive bonding such that they are seated on the bottom surface, with the cover sheets 66 keeping in place the stiffening elements 95 to a greater extent, while they also help preserve their undulated shapes shown in FIG. 25 (against buckling). Thereby their transverse stiffening effect is also reinforced. In the present embodiment the application of the central stiffening element provides for the pallet as a structure an outstandingly high bending strength.

Figure 26:
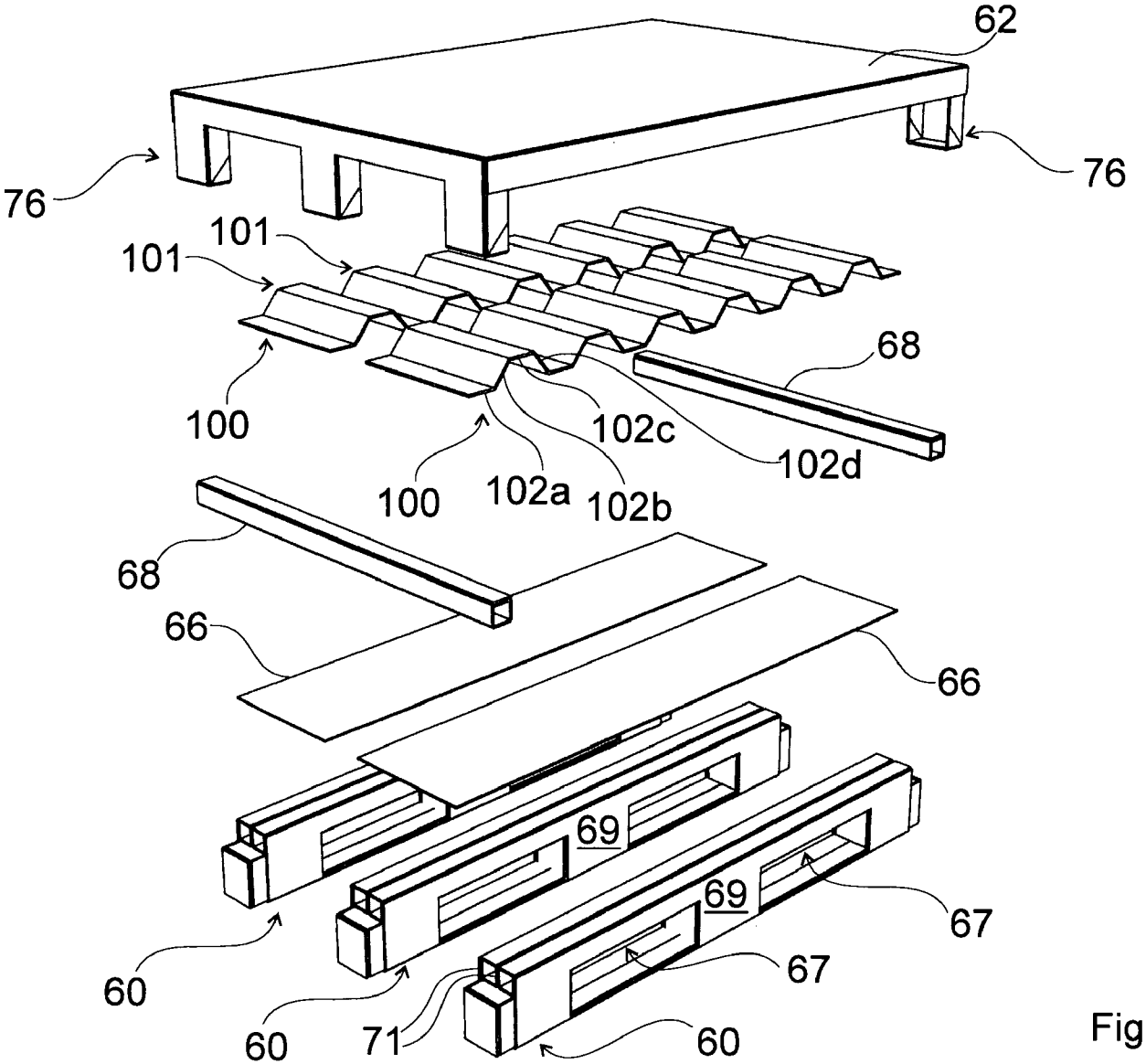
FIG. 26 is an exploded view of a further embodiment of the pallet according to the invention.

In the embodiment according to FIG. 26 a further central stiffening element 100 is arranged which is formed by a second open profile element comprising second ribs 101 extending perpendicular to the longitudinal direction of the foot elements 60. As with the stiffening element 95, this stiffener also has an essentially undulated shape, with the difference that—when the stiffening element 100 is arranged between the foot elements 60—the undulations (ribs) thereof are perpendicular to the side wall of the foot elements 60. Accordingly, in this embodiment the longitudinal stiffening is slightly weaker, and transverse stiffening is stronger, compared to the values that are experienced in the embodiment of FIG. 25. The stiffening element 100 shown in FIG. 26 has, by way of example, six ribs 101, with the arrangement of the sheet elements 102*a* (located further from the bottom surface in the assembled state) and the sheet elements 102*c* adapted to be seated on the bottom surface, as well as the obliquely arranged sheet elements 102*b* adapted to connect the sheet elements 102*a* and 102*c* and the oblique sheet elements 102*d* adapted to connect the sheet element 102*c* with the subsequent sheet element 102*a* being repeated inside the undulations. In the assembled state, the open profiles of the undulations (ribs 101) are supported against the side wall of the foot elements 60 in the region extending from the through openings 67 towards the bottom surface, with the outer (extreme) edges of the stiffening element 100 (for example the sheet element 102*a*) being supported against the outer transverse stiffening profile elements 68 that are arranged also in this embodiment. In order to cover the stiffening elements 100 there is also arranged a respective cover sheet 66 which also in this embodiment have a stabilizing effect on the stiffening elements 100.

The stiffening element 95 of FIG. 25 and the stiffening element 100 of FIG. 26 are of course preferably made from a foldable sheet material, e.g. cardboard (corrugated cardboard) or another paper material. The portions of the undulations that are seated on the bottom surface are preferably adhesively bonded thereto, and the edge supported against the foot element 60 or the edge supported against the outer transverse stiffening profile elements 68 is preferably adhesively bonded thereto.

Figure 27:
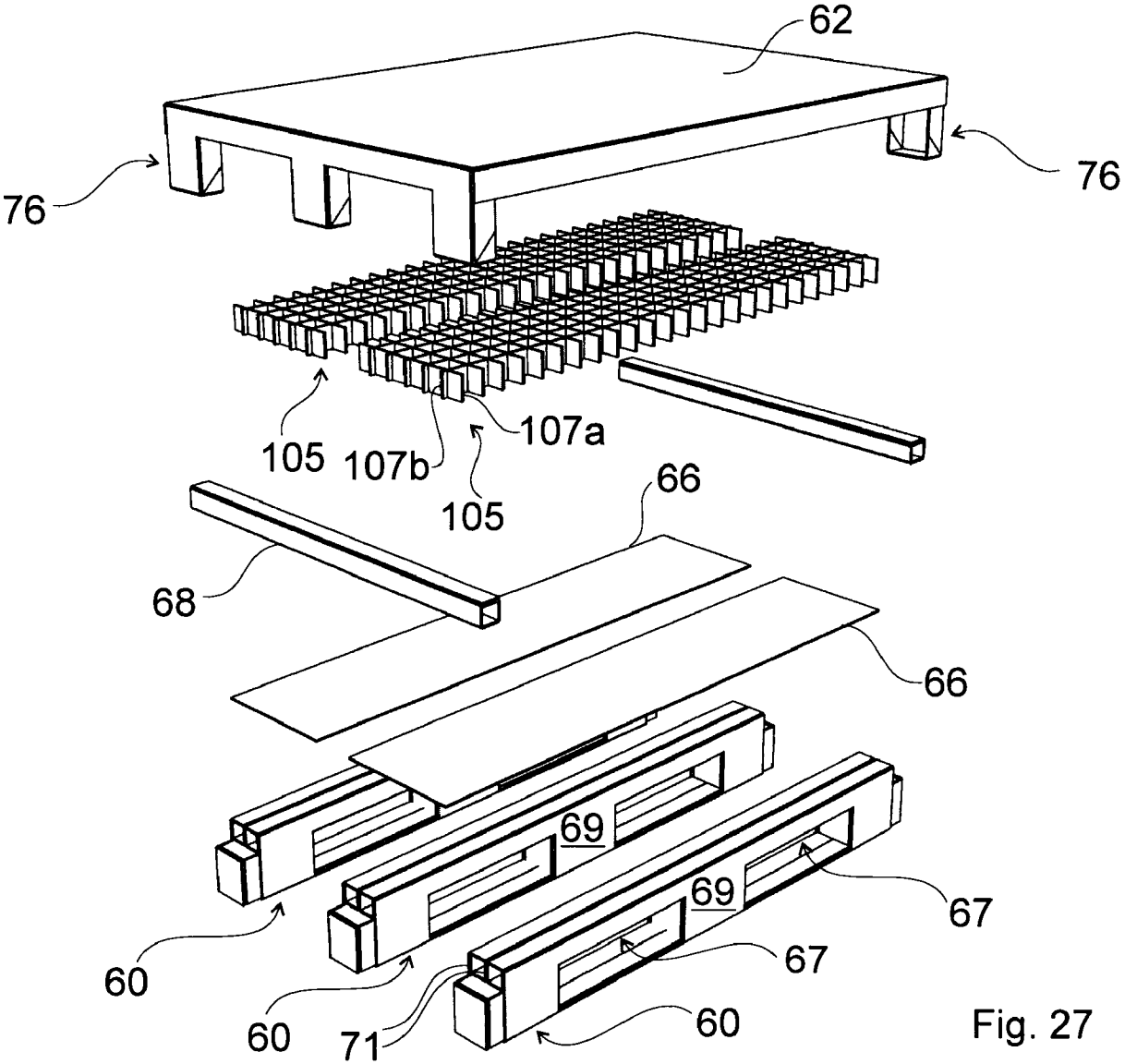
FIG. 27 is an exploded view of a yet further embodiment of the pallet according to the invention.

In FIG. 27 a still further embodiment of the pallet according to the invention is shown. In this embodiment there is arranged a central stiffening element 105. The stiffening element 105 is a grid structure made from foldable sheet material (preferably of corrugated cardboard, i.e. of paper), wherein the sheet elements are arranged at right angles (however, no folding is applied in the sheet elements). As shown in FIG. 27, the stiffening element 105 comprises sheet elements 107*a* and 107*b* being arranged perpendicular to each other, with the former being perpendicular to the foot elements 60 as they are arranged in the pallet (the end/edge of the sheet elements 107*a* is supported against the side wall of the foot elements 60), while the latter are parallel with the foot elements 60. The ends of the sheet elements 107*b* are supported on the outer transverse stiffening profile elements 68. Preferably the ends are adhesively bonded to the side wall of the foot element 60 in contact with them, or to the outer transverse stiffening profile element 68, with the upper side of the grid structure being preferably adhesively bonded to the bottom surface of the cover element 62. In this embodiment, therefore, the central stiffening element 105 comprises a second block comprising first sheet elements 1070*a* and second sheet elements 107*b* arranged in a comb-grid perpendicular to each other and to the bottom surface.

The height of the stiffening elements having a cover sheet is therefore nearly as large as the distance of the through openings 67 measured from the bottom surface (when the foot elements 60 are inserted in place). The stiffening element 105 according to this embodiment is preferably also covered applying the cover sheet 66.

Figure 28B:
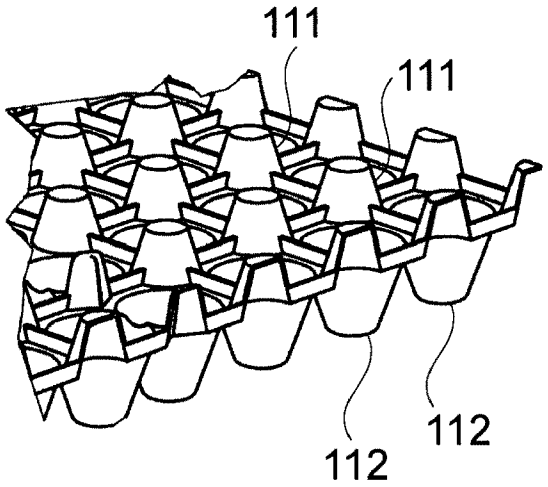
FIG. 28B depicts a detail of FIG. 28A.
Figure 28C:
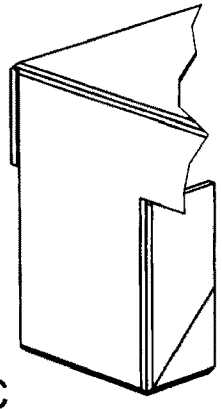
FIG. 28C depicts a further detail of FIG. 28A.
Figure 28A:
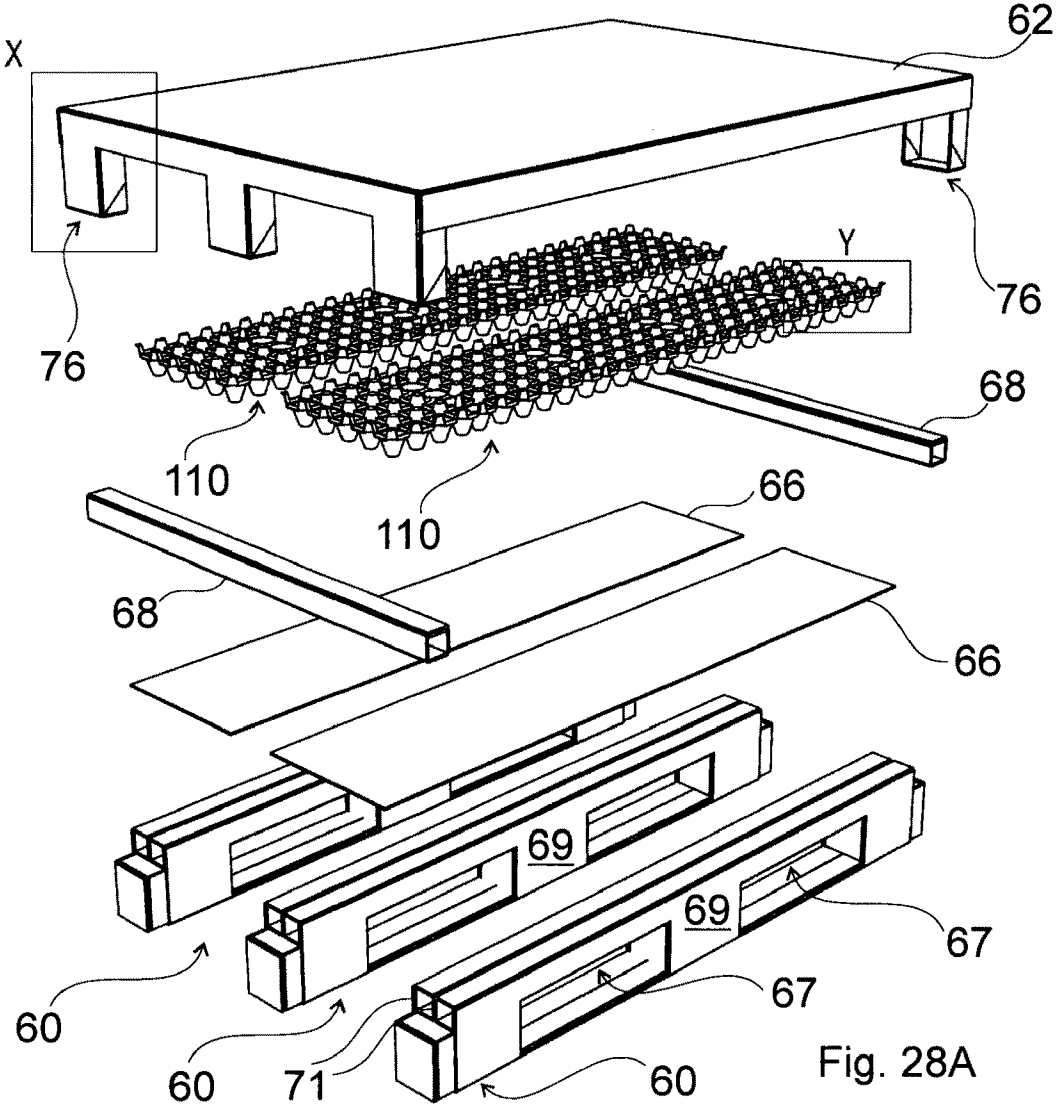
FIG. 28A is an exploded view of an embodiment of the pallet according to the invention.

In FIG. 28A a still further embodiment is shown that comprises a central stiffening element 110. The stiffening element 110 is an insert ("egg tray", made of the material of a typical egg tray, i.e. paper, typically recycled paper) that also has first support blocks 111 extending towards the bottom surface (and seated thereon) in the assembled state, and second support blocks 112 extending in an opposite direction (these latter are seated on the cover sheets 66). The seated portions can be secured by adhesive bonding. The side edge of the stiffening element 110 is seated on the side wall of the foot element 60, while its transverse-direction end portions are seated on the outer transverse stiffening profile elements 68 that are also arranged in this embodiment. Accordingly, the stiffening element 110 having an "egg tray" structure performs the role of a stiffener. A cover sheet 66 is therefore preferably also applied.

Preferably, adhesive bonding to the bottom surface and to the cover sheet is applied also for this stiffening element; this embodiment has preferable adhesive bonding characteristics because the support blocks of the stiffening element 110 has covering sheets, so surface-to-surface bonding can be applied.

In the embodiment according to FIG. 28A therefore, the central stiffening element 110 comprises a third block comprising support blocks arranged in a (preferably regular rectangular) grid with their covering plates abutted against the bottom sheet.

The different load conditions resulting from different use cases can be addressed applying different stiffening element configurations, i.e. optimal solutions (cost-optimized solutions) can be sought depending on the load conditions (for certain use cases it is sufficient to apply the stiffening element with the rigidity that matches the use conditions). For example, the solution utilizing a honeycomb-structure stiffening element has the highest loading capacity while it has optimal material use. That is to say, it is has the smallest material use, while the different embodiments have different material use. The lowest-cost embodiment is the one illustrated in FIG. 1. The rest of the described solutions are intended for various different purposes and are based on different cost optimization calculations. The effect mechanism of the transverse holders manifests itself with all types of central stiffening elements, but to different extents.

The structure of the central stiffening element can therefore be configured as a closed or open profile, or a block. The closed profile applied in the embodiment of FIGS. 1-21 has a rectangular (preferably square) cross section. The open profile is typically of a bellows-like configuration (see the embodiments of FIGS. 25-26), but the open profiles can also have I, Z, C or U-shaped cross-section. The stiffening element 105 of FIG. 27 e.g. has I-profile end portions, i.e. the sheet elements 107*a*, 107*b* have I-shaped ends. The Z-profile is a profile element bent to a Z shape, while the C- and U-profiles are three-sided profiles with an upright open end or a side-facing open end. In the central stiffening element, the advantages of block structures, such as the honeycomb mesh (FIG. 24A) structure and the comb grid structure (FIG. 27) are that they collectively improve load distribution and provide improved capacity for bearing distributed loads. These are thus the optimal solution in the case of high loads.

In the embodiments illustrated in FIGS. 22-28C the height of the central stiffening elements terminated in the cover sheets 66 is nearly equal to the distance between the through openings 67 and the bottom surface of the cover element.

This implies that automated strapping can be applied in these embodiments, too. In accordance with the above, automated strapping can be applied also in the case wherein there is a larger level difference between the upper edges of the central stiffening element and the through openings of the foot elements (i.e., the height of the central stiffening element, measured starting from the bottom surface is at least 50% of the distance measured between the through openings and the bottom surface), however, it is more advantageous if this level difference is small, even as small as the thickness of a single layer or smaller (i.e. the difference between the above introduced first height and first distance is smaller than 20%, preferably 10% of the greater of the first distance or the first height).

From the aspect of the forces, using the pallet involves several different conditions.

1. Static load, providing support to cargo
2. Rack storage
3. Lifting at the short side
4. Lifting at the long side
5. Dynamic loads occurring during moving the pallet Major force characteristics, loads placed by the cargo on the pallet 1. In the case of a static load, in the illustrated embodiments the cargo is supported by nine support points (studs). The load can be:

point-like,
distributed,
non-uniformly distributed.

The maximum load bearing capacity of the pallet's components has to be tested.

2. In the case of rack storage the pallet is preferably supported at six points. The structure of the pallet behaves as a two-support holder, of which the bending strength has to be tested.

3. In the case of lifting at the long side the surface support properties of the lifting fork have to be tested.

4. In the case of lifting at the short side the surface support properties of the lifting fork and the bending of the pallet ends have to be tested.

To sum up the above it is noted that the pallet according to the invention has the great advantage compared to known approaches that it is suited for bearing all the above listed load types (it is universally applicable in this regard). In addition to that, by selecting the appropriate central stiffening element the pallet structure can be adjusted to some extent (such that it is not overdimensioned to bear such loads which are never applied), but with all types of central stiffening elements it performs the functions of transverse stiffening and stretching the cover element. Universal applicability is fundamentally a result of the application of the central stiffening element, which allows that the foot element and the cover element cooperate such that they have synergic effect, i.e. mutually reinforce each other. This cooperation is absent from the known approaches.

The invention is, of course, not limited to the preferred embodiments described in details above, but further variants, modifications and developments are possible within the scope of protection determined by the claims.

The invention claimed is:

1. A pallet comprising a cover element having a load bearing surface and a bottom surface being opposite the load bearing surface, foot elements, each having a foot surface being parallel with the bottom surface, and side walls connecting the foot surface and the bottom surface, the foot elements being connected to the bottom surface, wherein the side walls facing to each other of adjacent foot elements—are parallel with each other, a central stiffening element being supported against the side walls facing to each other of adjacent foot elements, and being abutted against the bottom surface of the cover element, wherein the cover element and the foot elements are made from foldable sheet material, outer transverse stiffening profile elements being perpendicular to a longitudinal direction of the foot elements and arranged on the bottom surface of the cover element at the edges of the cover element, wherein one of the outer transverse stiffening profile elements perpendicular to the longitudinal direction of the foot elements is arranged at each edge of the cover element, and the central stiffening element is supported also against the outer transverse stiffening profile elements, and a corresponding end of each foot element is supported on the respective outer transverse stiffening profile element.

2. The pallet according to claim 1, wherein two through openings extending between the side walls of the respective foot element are formed in each foot element, a first height of the central stiffening element measured from the bottom surface is at least 50% of a first distance measured between the through openings and the bottom surface, and the central stiffening element is supported against the side walls of adjacent foot elements at a region extending from the through openings towards the bottom surface.

3. The pallet according to claim 1, wherein two through openings extending between the side walls of the respective foot element are formed in each foot element, a first difference between a first distance of the through openings measured from the bottom surface and a first height of the central stiffening element measured from the bottom surface is smaller than 20% of the greater of the first distance and the first height, and the central stiffening element is supported against the side walls of adjacent foot elements at a region extending from the through openings towards the bottom surface.

4. The pallet according to claim 3, wherein the first distance is greater than or equal to the first height.

5. The pallet according to claim 1, wherein the central stiffening element has a cover sheet being arranged between the side walls facing to each other of the adjacent foot elements, at a side of the central stiffening element lying opposite the bottom surface.

6. The pallet according to claim 1, wherein the central stiffening element is adhesively fixed to the side walls on which the central stiffening element is supported, and/or to the bottom surface against which the central stiffening element is abutted.

7. The pallet according to claim 1, wherein the foot element comprises a foot profile element on a side of the foot element facing the bottom surface, the foot profile element being made from foldable sheet material and having a same height relative to the bottom surface as the outer transverse stiffening profile element, and an end of the foot profile element being supported on the outer transverse stiffening profile element, projecting out from the foot elements at respective ends thereof, support elements are arranged bordered by the foot profile element, the side walls, and a region of the foot surface, and a projection length of the support elements from the foot element is equal to the width of the outer transverse stiffening profile element measured in the longitudinal direction of the foot element, and the outer transverse stiffening profile elements are arranged as being supported on the support elements projecting out from the foot elements in the corresponding direction.

8. The pallet according to claim 7, wherein covering sheets are connected to the cover element at the end of each foot element, with auxiliary sheets being connected to the covering sheets, a portion of the support element projecting out from the foot element being covered, except for another portion being in supporting connection with the outer transverse stiffening profile element, by the covering sheet and the auxiliary sheets being folded over the portion of the respective support elements projecting out from the foot element.

9. The pallet according to claim 1, wherein the central stiffening element includes at least one of a honeycomb-structure first block comprising cells having respective axes extending perpendicular to the bottom surface, or a first open profile element comprising first ribs extending parallel to a longitudinal direction of the foot elements, or a second open profile element comprising second ribs extending perpendicular to the longitudinal direction of the foot elements, or a second block comprising first sheet elements and second sheet elements arranged in a comb-grid perpendicular to each other and to the bottom surface, or a third block comprising support blocks arranged in a grid and having covering plates abutted against the bottom sheet.

10. The pallet according to claim 1, wherein the central stiffening element comprises at least one intermediate transverse stiffening profile element being supported against the adjacent foot elements by respective ends of the at least one intermediate transverse stiffening profile element and being arranged between the outer transverse stiffening profile elements, the outer transverse stiffening profile elements and the intermediate transverse stiffening profile element have a same height measured from the bottom surface, and the outer transverse stiffening profile elements and the intermediate transverse stiffening profile elements are made from foldable sheet material.

11. The pallet according to claim 10, wherein the outer transverse stiffening profile elements are supported by respective ends of the outer transverse stiffening profile elements against the foot elements adjacent thereto.

12. A pallet comprising a cover element having a load bearing surface and a bottom surface being opposite the load bearing surface, foot elements, each having a foot surface being parallel with the bottom surface, and side walls connecting the foot surface and the bottom surface, the foot elements being connected to the bottom surface, wherein the side walls facing to each other of adjacent foot elements—are parallel with each other, a central stiffening element being supported against the side walls facing to each other of adjacent foot elements, and being abutted against the bottom surface of the cover element, wherein the cover element and the foot elements are made from foldable sheet material, outer transverse stiffening profile elements being perpendicular to a longitudinal direction of the foot elements and arranged on the bottom surface of the cover element at the edges of the cover element, wherein the central stiffening element comprises at least one intermediate transverse stiffening profile element being supported against the adjacent foot elements by respective ends of the at least one intermediate transverse stiffening profile element and being arranged between the outer transverse stiffening profile elements, the outer transverse stiffening profile elements and the intermediate transverse stiffening profile element have a same height measured from the bottom surface, the outer transverse stiffening profile elements and the intermediate transverse stiffening profile elements are made from foldable sheet material, wherein two through openings extending between the side walls of the respective foot element are formed in each foot element, a distance between the through openings and the bottom surface is identical to a height of the intermediate transverse stiffening profile element measured from the bottom surface, and at least one respective intermediate transverse stiffening profile element is arranged at each through opening.

13. The pallet according to claim 12, further comprising a side covering sheet being formed integrally with the cover element from a material thereof, and being folded to the outer side walls of the outer foot elements as far as the through openings.

14. The pallet according to claim 12, wherein the central stiffening element comprises longitudinal stiffening profile elements being made from a foldable sheet material, being arranged between the outer transverse stiffening profile elements and the intermediate transverse stiffening profile elements adjacent thereto and/or between the intermediate transverse stiffening profile elements arranged at the through openings, and being supported by respective ends of the longitudinal stiffening profile elements against the respective transverse stiffening profile elements.

15. The pallet according to claim 14, wherein a height of the longitudinal stiffening profile elements measured from the bottom surface is the same as the height of the outer transverse stiffening profile elements and the intermediate transverse stiffening profile elements measured from the bottom surface.

16. The pallet according to claim 12, wherein at least one of the foot elements comprises a foot profile element being made from foldable sheet material, being arranged at the side of the foot element facing the bottom surface, and having a height measured from the bottom surface being identical to the distance between the through openings and the bottom surface.

17. The pallet according to claim 16, wherein the at least one of the foot elements is formed from a second folding preform comprising first openings and stiffening sheets, each of the stiffening sheets being adapted to project into a respective first opening, by folding each stiffening sheet back onto a side of a region corresponding to the foot surface situated opposite the foot surface, and a size of the respective stiffening sheets measured in a longitudinal direction of the foot surface is the same as a respective dimension of the through opening measured in the longitudinal direction of the foot surface, and support elements bordered by the foot profile element, the side walls, the region corresponding to the foot surface, and the ends of the stiffening sheets are arranged in the at least one of the foot elements.

* * * * *